US008301292B2

(12) United States Patent
Tokura

(10) Patent No.: US 8,301,292 B2
(45) Date of Patent: Oct. 30, 2012

(54) SEWING MACHINE AND NON-TRANSITORY COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/013,329

(22) Filed: Jan. 25, 2011

(65) Prior Publication Data

US 2011/0202165 A1 Aug. 18, 2011

(30) Foreign Application Priority Data

Feb. 12, 2010 (JP) ..... 2010-028832

(51) Int. Cl.
*D05C 5/02* (2006.01)

(52) U.S. Cl. ..... 700/138; 112/470.03; 112/470.04

(58) Field of Classification Search ..... 700/136–138; 112/102.5, 272, 470.01, 470.03, 470.04, 112/470.06, 475.19
See application file for complete search history.

(56) References Cited

U.S. PATENT DOCUMENTS

| | | | | |
|---|---|---|---|---|
| 4,834,008 | A * | 5/1989 | Sadeh et al. | 112/470.04 |
| 5,095,835 | A * | 3/1992 | Jernigan et al. | 112/470.04 |
| 5,271,345 | A * | 12/1993 | Matschulat et al. | 112/470.07 |
| 5,323,722 | A * | 6/1994 | Goto et al. | 112/102.5 |
| 5,911,182 | A * | 6/1999 | Uyama et al. | 112/102.5 |
| 6,032,594 | A | 3/2000 | Komuro | |
| 6,167,822 | B1 * | 1/2001 | Miyasako et al. | 112/102.5 |
| 6,173,665 | B1 | 1/2001 | Sekine | |
| 6,263,815 | B1 * | 7/2001 | Furudate | 112/470.13 |
| 6,820,565 | B1 | 11/2004 | Kawaguchi et al. | |
| 7,155,302 | B2 * | 12/2006 | Muto et al. | 700/138 |
| 7,325,502 | B2 * | 2/2008 | Konig et al. | 112/470.03 |
| 7,392,755 | B2 * | 7/2008 | Kato et al. | 112/102.5 |
| 8,091,493 | B2 * | 1/2012 | Tokura | 700/136 |
| 2007/0206371 | A1 | 9/2007 | Yamasaki | |

(Continued)

FOREIGN PATENT DOCUMENTS

EP 0 309 069 B1 3/1989

(Continued)

OTHER PUBLICATIONS

U.S. Appl. No. 13/213,570, filed in the name of Tokura on Aug. 19, 2011.

(Continued)

*Primary Examiner* — Nathan Durham
(74) *Attorney, Agent, or Firm* — Oliff & Berridge, PLC

(57) ABSTRACT

A sewing machine that includes a body, an embroidery frame moving mechanism, an image capture device, a specifying device, a determining device, a setting device, a positioning device, and an acquiring device. The image capture device is provided with a function to capture a plurality of images of the sewing object under a plurality of image capture conditions, respectively. The plurality of the image capture conditions correspond to different effective image capture ranges. The specifying device specifies, as a specific range, a range on the sewing object. The determining device determines a combination of a specific image capture condition and a positioning condition. The setting device sets the specific image capture condition as an actual image capture condition. The positioning device positions the embroidery frame in accordance with the positioning condition. The acquiring device acquires image data that corresponds to a specific effective image capture range.

12 Claims, 15 Drawing Sheets

U.S. PATENT DOCUMENTS

| | | | |
|---|---|---|---|
| 2009/0188413 | A1 | 7/2009 | Hirata et al. |
| 2009/0217850 | A1 | 9/2009 | Tokura |
| 2009/0266282 | A1 | 10/2009 | Suzuki et al. |
| 2010/0236463 | A1 | 9/2010 | Fujihara et al. |

FOREIGN PATENT DOCUMENTS

| | | | |
|---|---|---|---|
| JP | A-01-094891 | | 4/1989 |
| JP | A-2004-254987 | | 9/2004 |
| JP | A-2009-172123 | | 8/2009 |
| JP | A-2009-201704 | | 9/2009 |
| JP | A-2010-220694 | | 10/2010 |
| WO | WO 2009/085005 | A1 | 7/2009 |

OTHER PUBLICATIONS

European Search Report issued in Application No. 11153953.2-2314 dated Jun. 17, 2011.

Extended European Search Report issued in European Application No. 11177000.4; Dated Jan. 4, 2012.

May 3, 2012 Office Action issued in European Application No. 11 153 953.2.

* cited by examiner

FIG. 11

| RANGE / COORDINATE SYSTEM | POINT | FIRST CAMERA POSITION | SECOND CAMERA POSITION |
|---|---|---|---|
| WORK CLOTH RANGE / IMAGE COORDINATES | FIRST POINT | (210, 0) | (0, 0) |
| | SECOND POINT | (639, 0) | (639, 0) |
| | THIRD POINT | (210, 479) | (0, 479) |
| | FOURTH POINT | (639, 479) | (639, 479) |
| WORK CLOTH RANGE / WORLD COORDINATES | FIRST POINT | (-27.4, -12.5, -1.0) | (-27.0, -38.2, -1.0) |
| | SECOND POINT | (31.9, -11.9, -1.0) | (32.3, -38.3, -1.0) |
| | THIRD POINT | (-28.8, 40.5, -1.0) | (-28.8, 40.5, -1.0) |
| | FOURTH POINT | (31.8, 42.4, -1.0) | (31.7, 42.4, -1.0) |
| EFFECTIVE IMAGE CAPTURE RANGE / WORLD COORDINATES | FIRST POINT | (-27.4, -11.9, -1.0) | (-27.0, -38.2, -1.0) |
| | SECOND POINT | (31.7, -11.9, -1.0) | (31.7, -38.2, -1.0) |
| | THIRD POINT | (-27.4, 40.5, -1.0) | (-27.0, 40.5, -1.0) |
| | FOURTH POINT | (31.7, 40.5, -1.0) | (31.7, 40.5, -1.0) |

FIG. 14

| EMBROIDERY FRAME | FIRST CAMERA POSITION | SECOND CAMERA POSITION |
|---|---|---|
| FIRST FRAME POSITION | (29.55, 26.2) | (77.35, 39.35) |
| SECOND FRAME POSITION | (88.65, 26.2) | (136.05, 39.35) |
| THIRD FRAME POSITION | (88.65, 78.6) | (136.05, 118.05) |
| FOURTH FRAME POSITION | (29.55, 78.6) | (77.35, 118.05) |
| FIFTH FRAME POSITION | (29.55, 131) | – |
| SIXTH FRAME POSITION | (88.65, 131) | – |
| MOVE DISTANCES (mm) | 321.59 | 282.88 |

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-028832, filed Feb. 12, 2010, the content of which is hereby incorporated herein by reference in its entirety.

BACKGROUND

The present disclosure relates to a sewing machine that is provided with an image capture device and with an embroidery frame moving mechanism that moves an embroidery frame in relation to a body of the sewing machine and also relates to a non-transitory computer-readable medium that stores a sewing machine control program.

A sewing machine is known that is provided with an image capture device such as a camera or the like. Generally, the image capture device is provided in the vicinity of a needle bar for the purpose of capturing an image of an area around a needle (what would be called the foot of the needle). For example, a known sewing machine is provided with a camera that can be moved on a circle at the center of which is an axis of the needle bar. The known sewing machine moves the camera in accordance with a sewing direction. A sewing machine has also been proposed in which an image capture device is used for a purpose other than capturing an image of the area around the needle. For example, a known sewing machine is provided with an image capture device that captures an image of a work cloth that is held in an embroidery frame, and based on the image data that is acquired by the image capture device, the sewing machine specifies the position of a marker that is affixed to the work cloth. In the sewing machine, a sewing position in an embroidery pattern is set based on the specified position of the marker.

SUMMARY

Various members that are provided in the body of the sewing machine are disposed in the vicinity of the needle, the members being a presser foot, a needle-threading member for threading a thread through the eye of the needle, and the like. The members are positioned within an image capture range of the image capture device. Accordingly, the members are visible in an image that is acquired by the image capture device. Therefore, when the sewing machine detects the marker that is affixed to the work cloth, for example, the presence of the members in the image may make the image processing more complicated. The effect of making the image processing more complicated becomes greater as the embroidery frame becomes larger, so more time may be required in order to detect the marker.

Various exemplary embodiments of the broad principles derived herein provide a sewing machine and a non-transitory computer-readable medium that stores a sewing machine control program that improve convenience when an image is captured of an object to be sewn that is held in the embroidery frame.

Exemplary embodiments provide a sewing machine that includes a body, an embroidery frame moving mechanism, an image capture device, a specifying device, a determining device, a setting device, a positioning device, and an acquiring device. The embroidery frame moving mechanism is adapted to removably hold and move an embroidery frame in relation to the body, the embroidery frame holding a sewing object. The image capture device is provided with a function to capture a plurality of images of the sewing object under a plurality of image capture conditions, respectively. The plurality of the image capture conditions correspond to different effective image capture ranges. Each of the effective image capture ranges is set as an effective range within a range in which the image of the sewing object is captured. The specifying device specifies, as a specific range, a range on the sewing object to be captured by the image capture device. The determining device determines a combination of a specific image capture condition and a positioning condition based on the specific range specified by the specifying device. The specific image capture condition is a condition for capturing at least one image that covers an entirety of the specific range and includes at least one of the plurality of the image capture conditions. The positioning condition is a condition including at least one position to which the embroidery frame can be moved. The setting device sets the specific image capture condition that has been determined by the determining device as an actual image capture condition for the image capture device. The positioning device positions the embroidery frame in accordance with the positioning condition that has been determined by the determining device by controlling the embroidery frame moving mechanism. The acquiring device causes the image capture device to capture an image of the sewing object in a state in which the actual image capture condition has been set by the setting device and the embroidery frame has been positioned by the positioning device, and acquires image data that corresponds to a specific effective image capture range. The specific effective image capture range is one of the effective image capture ranges and corresponds to the actual image capture condition.

Exemplary embodiments further provide a non-transitory computer-readable medium storing a control program executable on a sewing machine. The program includes instructions that cause a controller of the sewing machine to perform the steps of specifying, as a specific range, a range on the sewing object to be captured by a image capture device, the image capture device being provided with a function to capture a plurality of images of the sewing object that is held by an embroidery frame under a plurality of image capture conditions, respectively, the plurality of the image capture conditions corresponding to different effective image capture ranges, each of the effective image capture ranges being set as an effective range within a range in which the image of the sewing object is captured, determining, based on the specific range, a combination of a specific image capture condition and a positioning condition, the specific image capture condition being a condition for capturing at least one image that covers an entirety of the specific range and including at least one of the plurality of the image capture conditions, the positioning condition being a condition including at least one position to which the embroidery frame can be moved, setting the specific image capture condition as an actual image capture condition for the image capture device, positioning the embroidery frame in accordance with the positioning condition, by controlling an embroidery frame moving mechanism that is adapted to removably hold and move the embroidery frame in relation to a body, and causing the image capture device to capture an image of the sewing object and acquiring, in a state in which the actual image capture condition for the image capture device has been set and the embroidery frame has been positioned in accordance with the positioning condition, image data that corresponds to a specific effective image capture range, the specific effective image capture range being one of the effective image capture ranges and corresponding to the actual image capture condition.

BRIEF DESCRIPTION OF THE DRAWINGS

Exemplary embodiments will be described below in detail with reference to the accompanying drawings in which:

FIG. 11 is a table that shows computed values for image coordinates in a work cloth range, world coordinates in the work cloth range, and world coordinates in an effective image capture range for the first camera position and the second camera position;

FIG. 14 is a table that shows movement distances of an embroidery frame 84 that are computed for each combination of camera position and positioning condition.

DETAILED DESCRIPTION

Hereinafter, a multi-needle sewing machine 1 (hereinafter simply called the sewing machine 1) that is an embodiment will be explained with reference to the drawings. The referenced drawings are used for explaining technical features that may be utilized in the present disclosure, and the device configurations, the flowcharts and the like that are described are simply explanatory examples that do not limit the present disclosure to only those configurations and the like.

The physical configuration of the sewing machine 1 will be explained with reference to FIGS. 1 to 4. In the explanation that follows, the lower left side, the upper right side, the upper left side, and the lower right side of the page in FIG. 1 respectively indicate the front side, the rear side, the left side, and the right side of the sewing machine 1.

Figure 1:
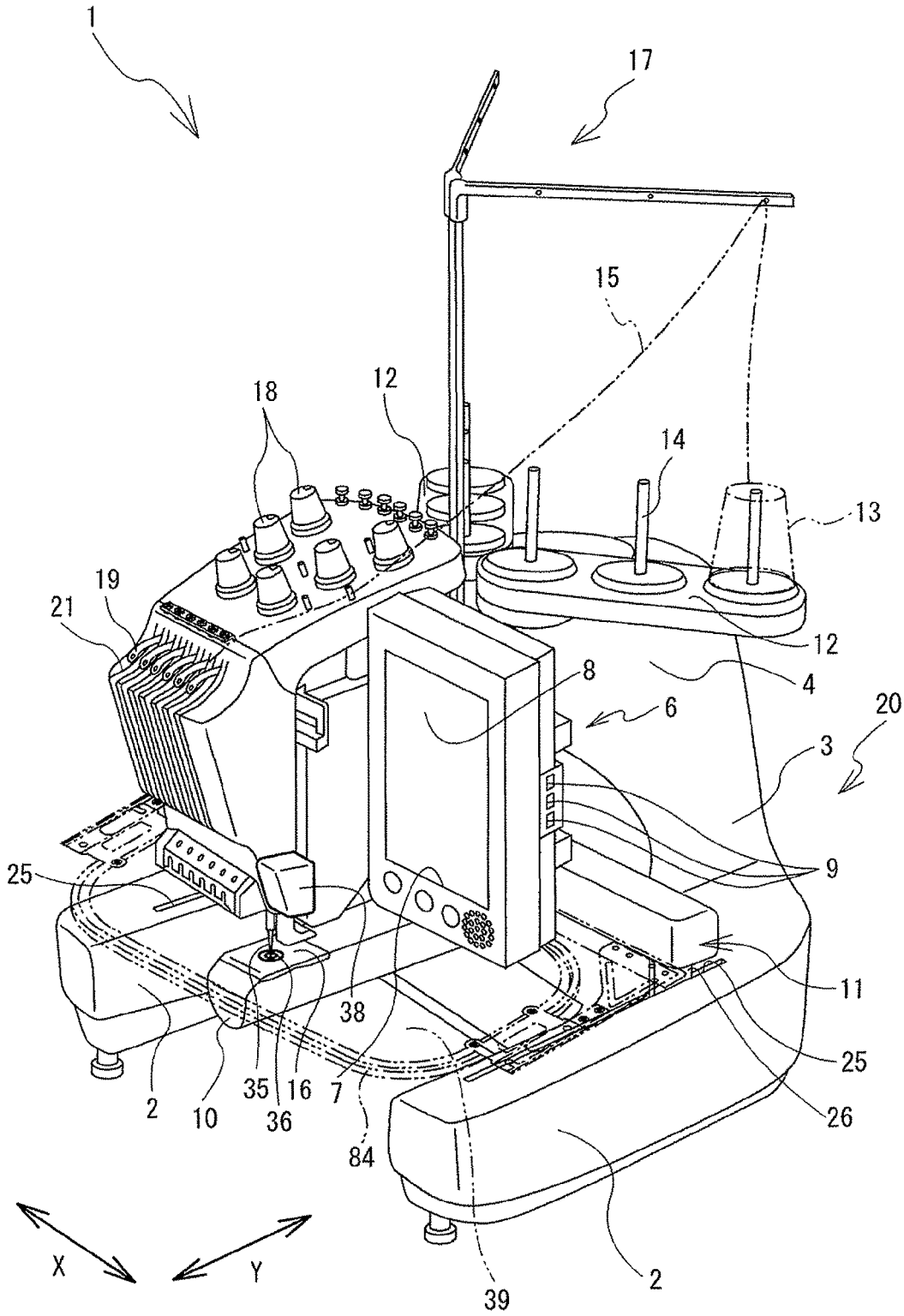
FIG. 1 is an oblique view of the multi-needle sewing machine 1.

As shown in FIG. 1, a body 20 of the sewing machine 1 is provided with a supporting portion 2, a pillar 3, and an arm 4. The supporting portion 2 is formed in an inverted U shape in a plan view, and the supporting portion 2 supports the entire sewing machine 1. A pair of left and right guide slots 25 that extend in the front-to-rear direction are provided on the top face of the supporting portion 2. The pillar 3 is provided such that it rises upward from the rear portion of the supporting portion 2. The arm 4 extends forward from the upper end of the pillar 3. A needle bar case 21 is mounted on the front end of the arm 4 such that the needle bar case 21 can move to the left and to the right. The needle bar case 21 and a needle bar case moving mechanism 40 (refer to FIG. 3) that moves the needle bar case 21 will be described in detail later.

An operation portion 6 is provided on the right side of the arm 4 at a central position in the front-to-rear direction. The operation portion 6 is pivotally supported by the arm 4 around a vertically extending shaft (not shown in the drawings) as an axis. The operation portion 6 is provided with a liquid crystal display 7 (hereinafter simply called the LCD 7), a touch panel 8, and connectors 9. An operation screen for a user to input commands, for example, may be displayed on the LCD 7. The touch panel 8 may be used to accept commands from the user. The user can select various types of conditions relating to a sewing pattern and sewing by using a finger, a stylus pen or the like to perform a pressing operation (the operation hereinafter being called a panel operation) on a location on the touch panel 8 that corresponds to a position of n image showing an input key or the like displayed on the LCD 7. The connectors 9 are USB standard connectors, and a USB device 160 (refer to FIG. 5) can be connected to them.

A cylindrical cylinder bed 10 that extends forward from the bottom end of the pillar 3 is provided underneath the arm 4. A shuttle (not shown in the drawings) is provided in the interior of the front end of the cylinder bed 10. A bobbin (not shown in the drawings) on which a lower thread (not shown in the drawings) is wound may be accommodated in the shuttle. A shuttle drive mechanism (not shown in the drawings) is also provided in the interior of the cylinder bed 10. The shuttle drive mechanism rotationally drives the shuttle. A needle plate 16 that is rectangular in a plan view is provided on the top face of the cylinder bed 10. A needle hole 36 through which a needle 35 passes is provided in the needle plate 16.

An embroidery frame moving mechanism 11 is provided underneath the arm 4. The sewing machine 1 performs sewing of an embroidery pattern on a work cloth 39 that is held by an embroidery frame 84 by moving the embroidery frame 84 to the left and the right, and forward and backward, by an X axis motor 132 (refer to FIG. 5) and a Y axis motor 134 (refer to FIG. 5) of the embroidery frame moving mechanism 11. The work cloth 39 is a sewing object. The embroidery frame moving mechanism 11 will be described in detail later.

A right-left pair of spool platforms 12 are provided at the rear face side of the top face of the arm 4. Three thread spool pins 14 are provided on each of the spool platforms 12. The thread spool pins 14 are pins that extend in the vertical direction. The thread spool pins 14 support thread spools 13. The number of the thread spools 13 that can be placed on the one pair of the spool platforms 12 is six, the same as the number of needle bars 31. Upper threads 15 may be supplied from the thread spools 13 that are attached to the spool platforms 12. Each of the upper threads 15 may be supplied, through a thread guide 17, a tensioner 18, and a thread take-up lever 19, to an eye (not shown in the drawings) of each of the needles 35 that are attached to the bottom ends of the needle bars 31 respectively.

Figure 2:
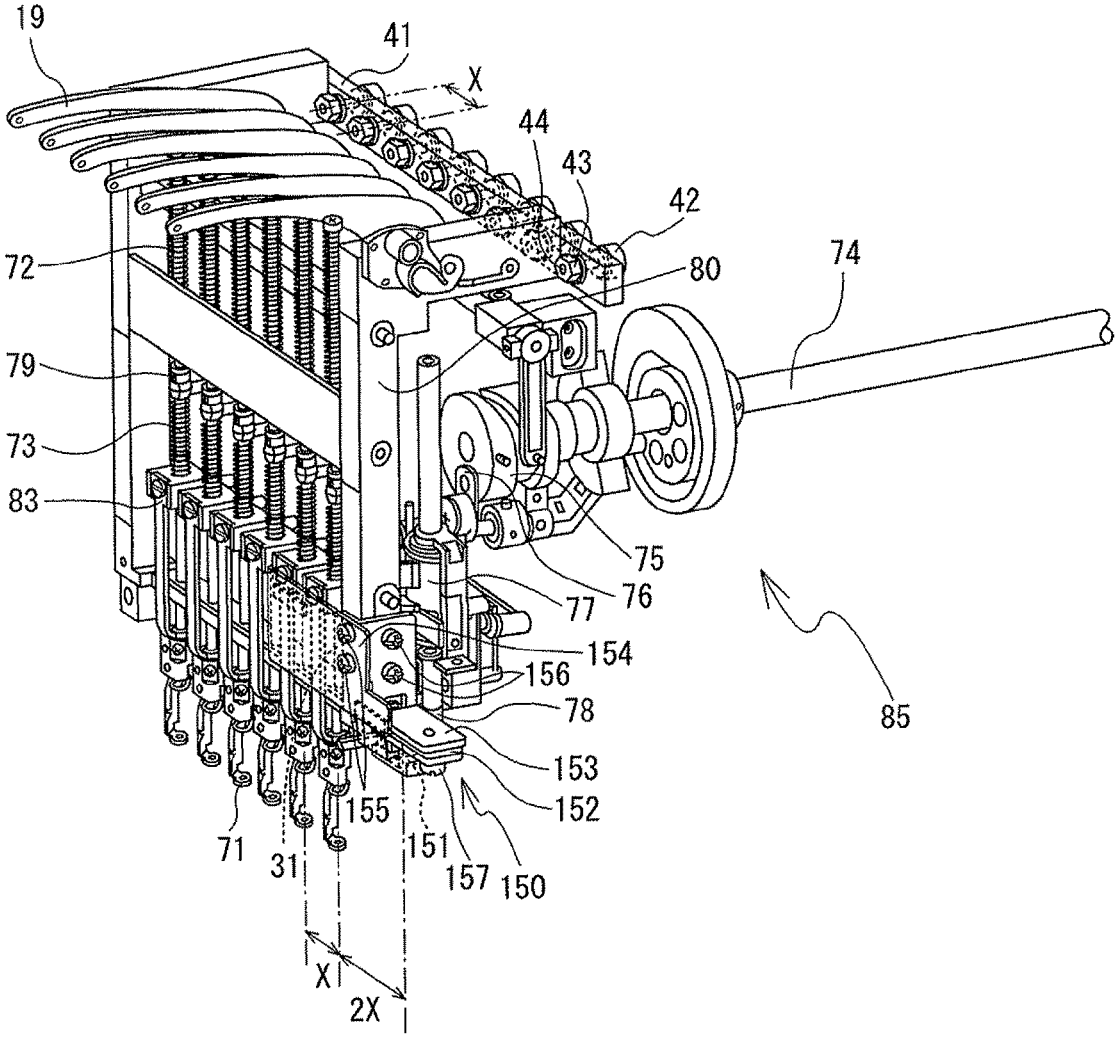
FIG. 2 is an oblique view that shows a needle bar drive mechanism 85 in an interior of a needle bar case 21.

Next, an internal mechanism of the needle bar case 21 will be explained with reference to FIG. 2. As shown in FIG. 2, the six needle bars 31 that extend in the vertical direction are provided inside the needle bar case 21 at equal intervals X in the left-right direction. A needle bar number is assigned to each of the needle bars 31 in order to identify the individual needle bars 31. In the present embodiment, the needle bar numbers 1 to 6 are assigned in order starting from the right side in FIG. 2. The needle bars 31 are supported by upper and lower securing members (not shown in the drawings) that are secured to a frame 80 of the needle bar case 21, such that the needle bars 31 can slide up and down. A needle bar follow spring 72 is provided on the upper half of each of the needle bars 31, and a presser spring 73 is provided on the lower half of each of the needle bars 31. A needle bar guide 79 is provided between the needle bar follow spring 72 and the presser spring 73, and a presser guide 83 is provided below the presser spring 73. The needle bars 31 are slid up and down by a needle bar drive mechanism 85. The needle bar drive mechanism 85 includes a sewing machine motor 122 (refer to FIG. 5), a thread take-up lever drive cam 75, a coupling member 76, a transmitting member 77, a guide bar 78, and a coupling pin (not shown in the drawings). The sewing machine motor 122 is a drive source for the needle bar drive mechanism 85. The needles 35 (refer to FIG. 1) may be attached to the bottom ends of the needle bars 31. A presser foot 71 is formed to extend from each of the presser guides 83 to slightly below the bottom end portion (the tip portion) of the corresponding needle 35, and operates in conjunction with the up-and-down movement of the corresponding needle bar 31 to presses intermittently the work cloth 39 (refer to FIG. 1) downward.

An image sensor holding mechanism 150 is attached to the lower portion of the right side face of the frame 80. The image sensor holding mechanism 150 is provided with an image sensor 151, a holder 152, a supporting member 153, and a connecting plate 154. The image sensor 151 is a known complementary metal oxide semiconductor (CMOS) image sensor. The holder 152 supports the image sensor 151 in a state in which a lens (not shown in the drawings) of the image sensor 151 faces downward. The center of the lens of the image sensor 151 is in a position that is at a distance 2X from the needle bar 31 that is the farthest to the right. The supporting member 153 has an L shape when viewed from the front, and the supporting member 153 supports the connecting plate 154 and the holder 152. The supporting member 153 is secured to the lower portion of the right side face of the frame 80 by screws 156. The holder 152 is secured to the bottom face of the supporting member 153 by a screw 157. The connecting plate 154 is a plate that is L-shaped when viewed from the front, and the connecting plate 154 electrically connects the image sensor 151 to a control portion 140 that will be described later (refer to FIG. 5). The connecting plate 154 is secured to the front face of the supporting member 153 by screws 155. The front face, the top face, and the right side face of the image sensor holding mechanism 150 are covered by a cover 38 (refer to FIG. 1).

Figure 3:
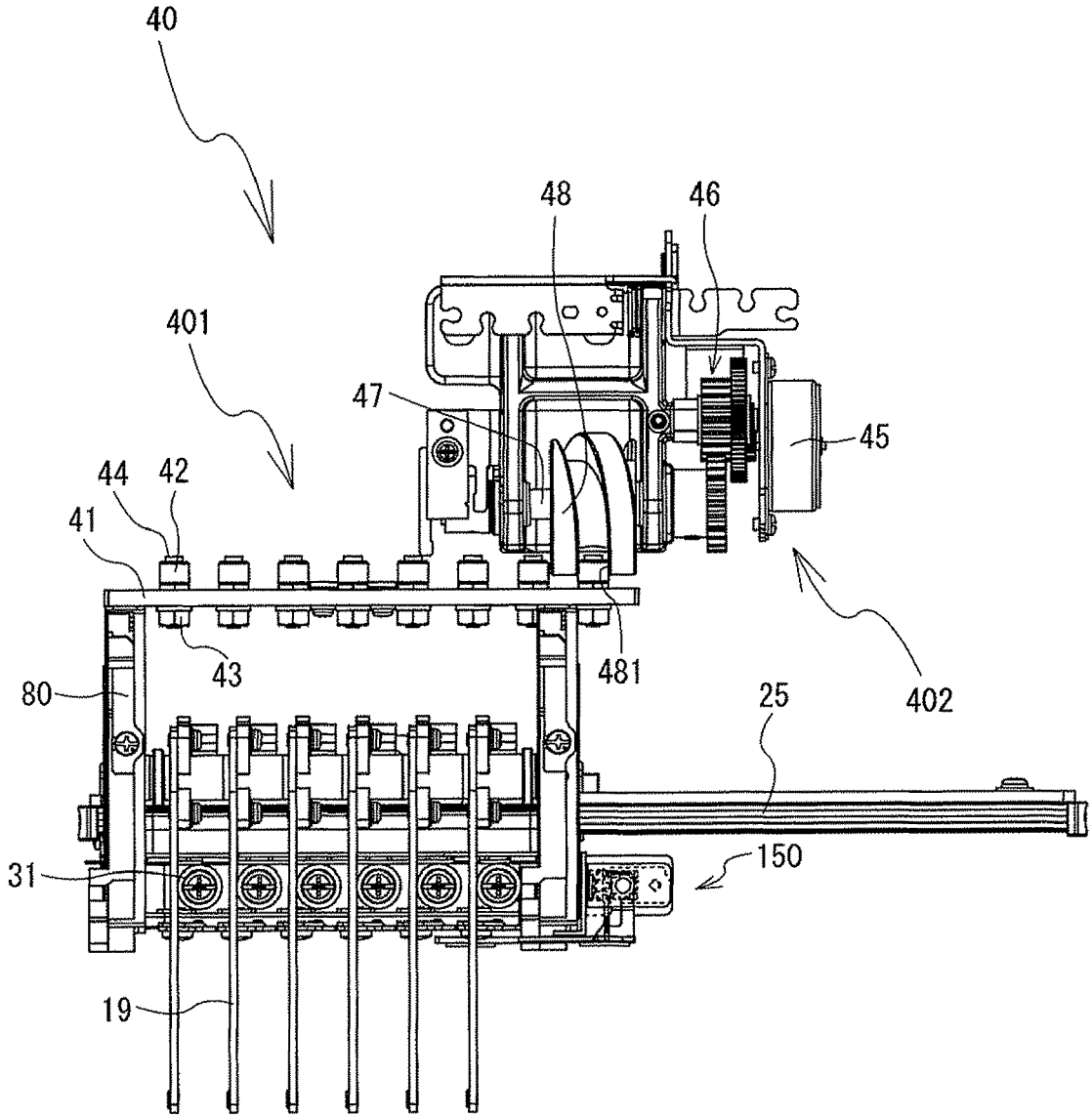
FIG. 3 is a plan view that shows a needle bar case moving mechanism 40.

The needle bar case moving mechanism 40 that moves the needle bar case 21 will be explained with reference to FIGS. 2 and 3. In FIG. 3, the lower side, the upper side, the left side, and the right side of the page respectively indicate the front side, the rear side, the left side, and the right side of the sewing machine 1.

As shown in FIG. 3, the needle bar case moving mechanism 40 is provided with an engaging roller portion 401 and a needle bar case drive portion 402. The engaging roller portion 401 includes a plate 41, engaging rollers 42, nuts 43, and shoulder screws 44. The plate 41 is attached to the rear edge of the upper portion of the frame 80, as shown in FIGS. 2 and 3. The plate 41 has a plate shape that is long in the left-right direction. Each of eight of the engaging rollers 42 is attached by one of the shoulder screws 44 to the rear face of the plate 41. Each of the engaging rollers 42 has a cylindrical shape, although this is not shown in detail in the drawings, and is supported by one of the shoulder screws 44 such that each of the engaging rollers 42 can rotate, but cannot move in the axial direction of the engaging roller 42. The shoulder screws 44 are inserted into holes in the plate 41 (not shown in the drawings). The tips of the shoulder bolts 44 (the tips of male threaded portions) are secured by nuts 43. The intervals between the engaging rollers 42 are all the same as the intervals X between the needle bars 31. The heights at which the eight engaging rollers 42 are attached are all the same.

The needle bar case drive portion 402 is located in the interior of the arm 4 (refer to FIG. 1), in a position that is to the rear of the plate 41. The needle bar case drive portion 402 includes a needle bar case motor 45, a gear portion 46, a rotating shaft 47, and a helical cam 48. The needle bar case motor 45 is a pulse motor. The needle bar case motor 45 is affixed such that the axial direction of an output shaft (not shown in the drawings) of the needle bar case motor 45 is oriented in the right-to-left direction. The needle bar case motor 45 transmits a driving force to the rotating shaft 47 via a gear portion 46, thus rotating the helical cam 48 by a specified amount. The rotating shaft 47 is supported in parallel with the output shaft of the needle bar case motor 45. The helical cam 48 is secured to the outer circumference of the rotating shaft 47 and is at all times engaged with one of the eight engaging rollers 42. The helical cam 48 includes a positioning portion 481. In a case where the rotation of the rotating shaft 47 has been stopped, one of the eight engaging rollers 42 is engaged with the positioning portion 481 of the helical cam 48. In the state in which one of the eight engaging rollers 42 is engaged with the positioning portion 481, the position in the left-right direction of the engaging roller 42 that is engaged with the helical cam 48, even in a case where the rotating shaft 47 has been rotated to a specified angle, is the same as before the rotating shaft 47 was rotated.

The operation of moving the needle bar case 21 will be explained with reference to FIGS. 2 and 3. The needle bar case 21 is moved by the needle bar case moving mechanism 40 in the left-right direction (the horizontal direction) in relation to the body 20 (refer to FIG. 1). Every time the helical cam 48 rotates 360 degrees, the needle bar case moving mechanism 40 can move the needle bar case 21 by the distance X along the left-light direction. The direction in which the needle bar case 21 moves is determined according to the direction of the rotation of the helical cam 48. In a case where the helical cam 48 rotates counterclockwise as seen from the right side, the needle bar case 21 moves to the left. In a case where the helical cam 48 rotates clockwise as seen from the right side, the needle bar case 21 moves to the right.

A number from 1 to 8 is assigned to each of the engaging rollers 42, starting from the left to the right, in accordance with the order in which the engaging rollers 42 are arranged. An initial position may be defined, for example, as the position in which the number 6 engaging roller 42 is engaged with the positioning portion 481 of the helical cam 48. At this time, the needle bar 31 with the needle bar number 1 is positioned directly above the needle hole 36. If the helical cam 48 is rotated clockwise as seen from the right side, the number 6 engaging roller 42 is slid toward the right side by the helical cam 48, and the frame 80 starts moving toward the right in relation to the body 20 (refer to FIG. 1). Next, the engaging of the number 6 engaging roller 42 with the helical cam 48 is released, and the number 5 engaging roller 42 engages with the helical cam 48. Thus, when the helical cam 48 makes one rotation clockwise from the initial position, as seen from the right side, the frame 80 moves to the right by the distance X, and the needle bar 31 with the needle bar number 2 is positioned directly above the needle hole 36. In contrast, when the helical cam 48 makes one rotation counterclockwise as seen from the right side, the frame 80 moves to the left in relation to the body 20 by the distance X. In this manner, every time the helical cam 48 makes one rotation, the needle bar case moving mechanism 40 can move the frame 80 to one of the left and the right by the distance X, according to the direction of the rotation of the helical cam 48.

The image sensor holding mechanism 150 is secured to the frame 80, so the position of the image sensor 151 in relation to the body 20 is changed by moving the needle bar case 21. In a case where the number 8 engaging roller 42 is engaged with the positioning portion 481 of the helical cam 48, the image sensor 151 is in a first camera position. In the first camera position, the image sensor 151 is positioned directly above the needle hole 36. In a case where the number 6 engaging roller 42 is engaged with the positioning portion 481 of the helical cam 48, the image sensor 151 is in a second camera position. In the second camera position, the image sensor 151 is in a position in which it has moved toward the right from the first camera position by a distance 2X (refer to FIG. 2).

Next, the embroidery frame 84 and the embroidery frame moving mechanism 11 will be explained with reference to FIG, 4. The embroidery frame 84 is provided with an outer frame 81, an inner frame 82, and a pair of left and right coupling portions 89. The embroidery frame 84 holds the work cloth 39 between the outer frame 81 and the inner frame 82. The coupling portions 89 are plate members that, in a plan view, have rectangular shapes in which rectangular center portions have been cut out. One of the coupling portions 89 is secured to the right portion of the inner frame 82 by screws 95, and the other of the coupling portions 89 is secured to the left portion of the inner frame 82 by screws 94. In addition to the embroidery frame 84, a plurality of types of other embroidery frames that differ in both size and shape can also be mounted on the sewing machine 1. Of the embroidery frames that can be used in the sewing machine 1, the embroidery frame 84 is the embroidery frame with the greatest width in the left-right direction (the distance between the left and right coupling portions 89). A sewing area 86 is defined in a position that is inside the inner frame 82, in accordance with the type of the embroidery frame 84.

The embroidery frame moving mechanism 11 includes a holder 24, an X carriage 22, an X axis drive mechanism (not shown in the drawings), a Y carriage 23, a Y axis drive mechanism (not shown in the drawings) and a detecting device 88. The holder 24 supports the embroidery frame 84 such that the embroidery frame 84 can be mounted and removed. The holder 24 is provided with an attaching portion 91, a right arm portion 92, a left arm portion 93, and a detection object portion 87. The attaching portion 91 is a plate member that is rectangular in a plan view, with its long sides running in the left-right direction. The right arm portion 92 is a plate member that extends in the front-rear direction and is secured to the right end of the attaching portion 91. The left arm portion 93 is a plate member that extends in the front-rear direction. The left arm portion 93 is secured to the left portion of the attaching portion 91 in a position that can be adjusted in the left-right direction in relation to the attaching portion 91. The right arm portion 92 is engaged with one of the coupling portions 89 of the embroidery frame 84, and the left arm portion 93 is engaged with the other of the coupling portions 89.

The distance between the left and right coupling portions 89 may be changed according to the type of the embroidery frame that is affixed to the holder 24. The user adjusts the position in the left-right direction of the left arm portion 93 in accordance with the embroidery frame that is used, then fixes the left arm portion 93 in that position. The detection object portion 87 is an elongated plate-shaped member that is provided in the left arm portion 93 and extends in the left-right direction. When the position of the left arm portion 93 in the left-right direction is adjusted, the detection object portion 87 moves with the left arm portion 93. A plurality of step portions (not shown in the drawings) are formed in the detection object portion 87 that make contact with a detecting element (not shown in the drawings) of the detecting device 88, which will be described later. The heights of the step portions differ for one another, such that the step portions form a stairway shape.

The detecting device 88 is affixed to the Y carriage 23. The detecting device 88 is a rotary potentiometer. A detailed illustration has been omitted, but the detecting element is provided on a rotating shaft of the potentiometer. The tip of the detecting element makes contact with one of the step portions of the detection object portion 87 at a time, and the detecting device 88 outputs an electrical signal in accordance with the angle of rotation of the detecting element. The heights of the step portions of the detection object portion 87 differ according to the position of the left arm portion 93 in relation to the attaching portion 91, in the left-right direction, that is, according to the type of the embroidery frame 84. It is therefore possible, based on the electrical signal that is output by the detecting device 88, to specify the type of the embroidery frame 84 that is attached to the embroidery frame moving mechanism 11. For example, Japanese Laid-Open Patent Publication No. 2004-254987 discloses the configuration of the detecting device 88 and the detection object portion 87, the relevant portions of which are herein incorporated by reference.

The X carriage 22 is a plate member, with its long dimension running in the left-right direction, and a portion of the X carriage 22 projects forward from the front face of the Y carriage 23. The attaching portion 91 of the holder 24 is attached to the X carriage 22, The X axis drive mechanism includes the X axis motor 132 (refer to FIG. 5) and a linear movement mechanism (not shown in the drawings). The X axis motor 132 is a stepping motor. The linear movement mechanism includes a timing pulley (not shown in the drawings) and a timing belt (not shown in the drawings), and the linear movement mechanism moves the X carriage 22 to the left and to the right (in the X axis direction) using the X axis motor 132 as its drive source.

The Y carriage 23 has a box shape, with its long dimension running in the left-right direction. The Y carriage 23 supports the X carriage 22 such that the X carriage 22 can move to the left and to the right. The Y axis drive mechanism includes a pair of left and right moving bodies 26 (refer to FIG. 1), the Y axis motor 134 (refer to FIG. 5), and a linear movement mechanism (not shown in the drawings). The moving bodies 26 are coupled to the bottom portions of the left and right ends of the Y carriage 23 respectively and pass vertically through the guide slots 25 (refer to FIG. 1). The Y axis motor 134 is a stepping motor. The linear movement mechanism includes a timing pulley (not shown in the drawings) and a timing belt (not shown in the drawings), and the linear movement mechanism moves the moving bodies 26 forward and backward (in the Y axis direction) along the guide slots 25 using the Y axis motor 134 as its drive source.

Figure 4:
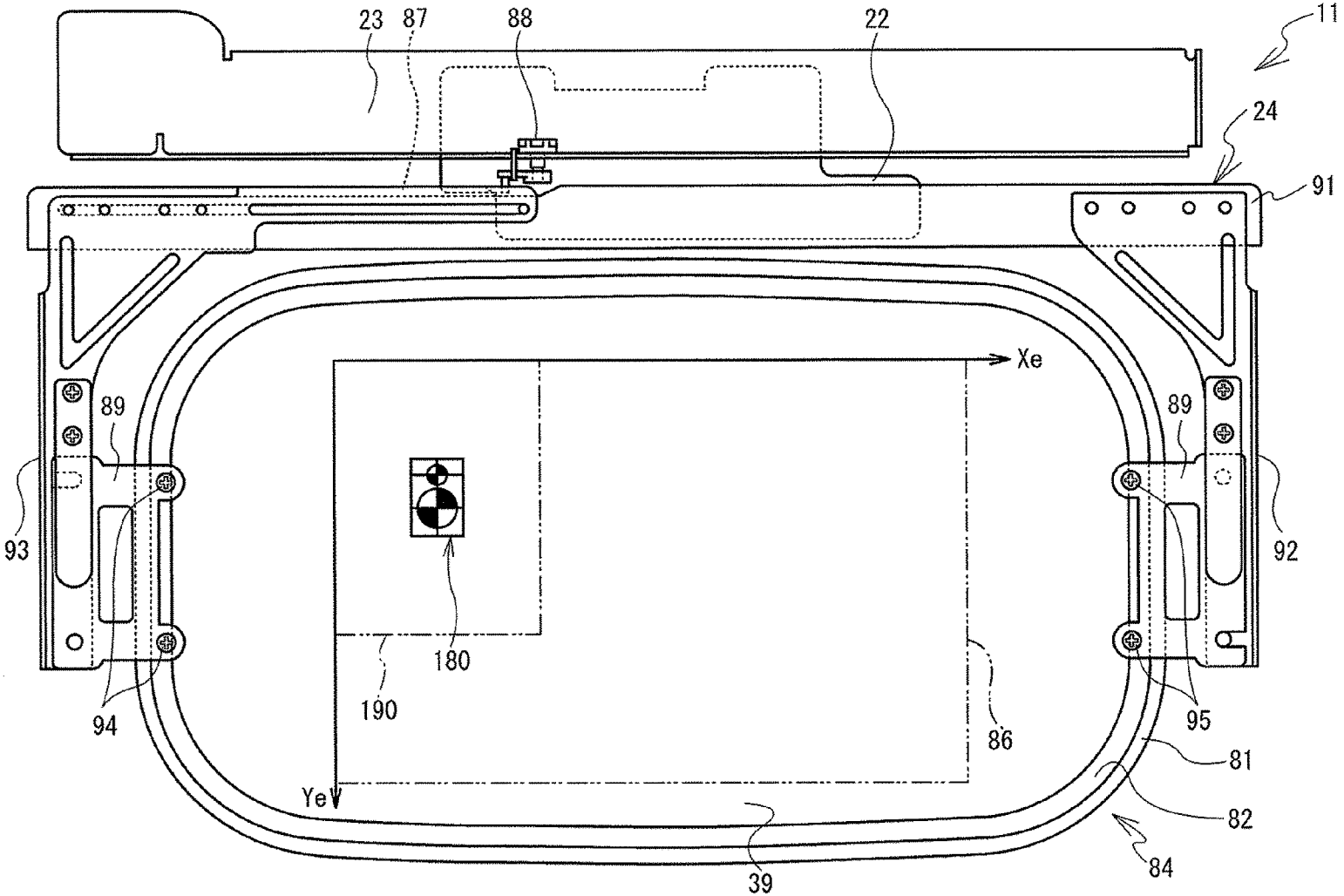
FIG. 4 is a plan view of an embroidery frame moving mechanism 11.

The embroidery frame 84 is moved in two specified directions (in the left-right direction and the front-rear direction) by the embroidery frame moving mechanism 11, in accordance with data that is expressed in terms of a coordinate system of the embroidery frame moving mechanism 11 (hereinafter called the embroidery coordinate system). The embroidery coordinate system in the present embodiment corresponds to a world coordinate system. The embroidery coordinate system (Xe, Ye), for example, can be set such that it defines the upper left corner of the sewing area 86 as the origin point, as shown in FIG. 4.

Next, the operation that forms a stitch on the work cloth 39 that is held by the embroidery frame 84 will be explained with reference to FIGS. 1 to 5. The embroidery frame 84 by which the work cloth 39 is held is supported by the holder 24 of the embroidery frame moving mechanism 11 (refer to FIGS. 1 and 4). First, one of the six needle bars 31 is selected by the moving of the needle bar case 21 in the left-right direction. The embroidery frame 84 is moved to a specified position by the embroidery frame moving mechanism 11. The needle bar drive mechanism 85 is driven when a main shaft 74 is rotated by the sewing machine motor 122. The rotational movement of the main shaft 74 is transmitted to the coupling member 76 through the thread take-up lever drive cam 75, and the transmitting member 77, on which the coupling member 76 is pivotably supported, is driven up and down, being guided by the guide bar 78, which is positioned parallel to the needle bar 31. The up-and-down movement is transmitted to the needle bar 31 through the coupling pin (not shown in the drawings), and the needle bar 31, to which the needle 35 is attached, is driven up and down. Through a link mechanism that is not shown in detail in the drawings, the thread take-up lever 19 is driven up and down by the rotation of the thread take-up lever drive cam 75. Furthermore, the rotation of the main shaft 74 is transmitted to the shuttle drive mechanism (not shown in the drawings), and the shuttle (not shown in the drawings) is rotationally driven. Thus the needle 35, the thread take-up lever 19, and the shuttle are driven in synchronization, and a stitch is formed on the work cloth 39.

Figure 5:
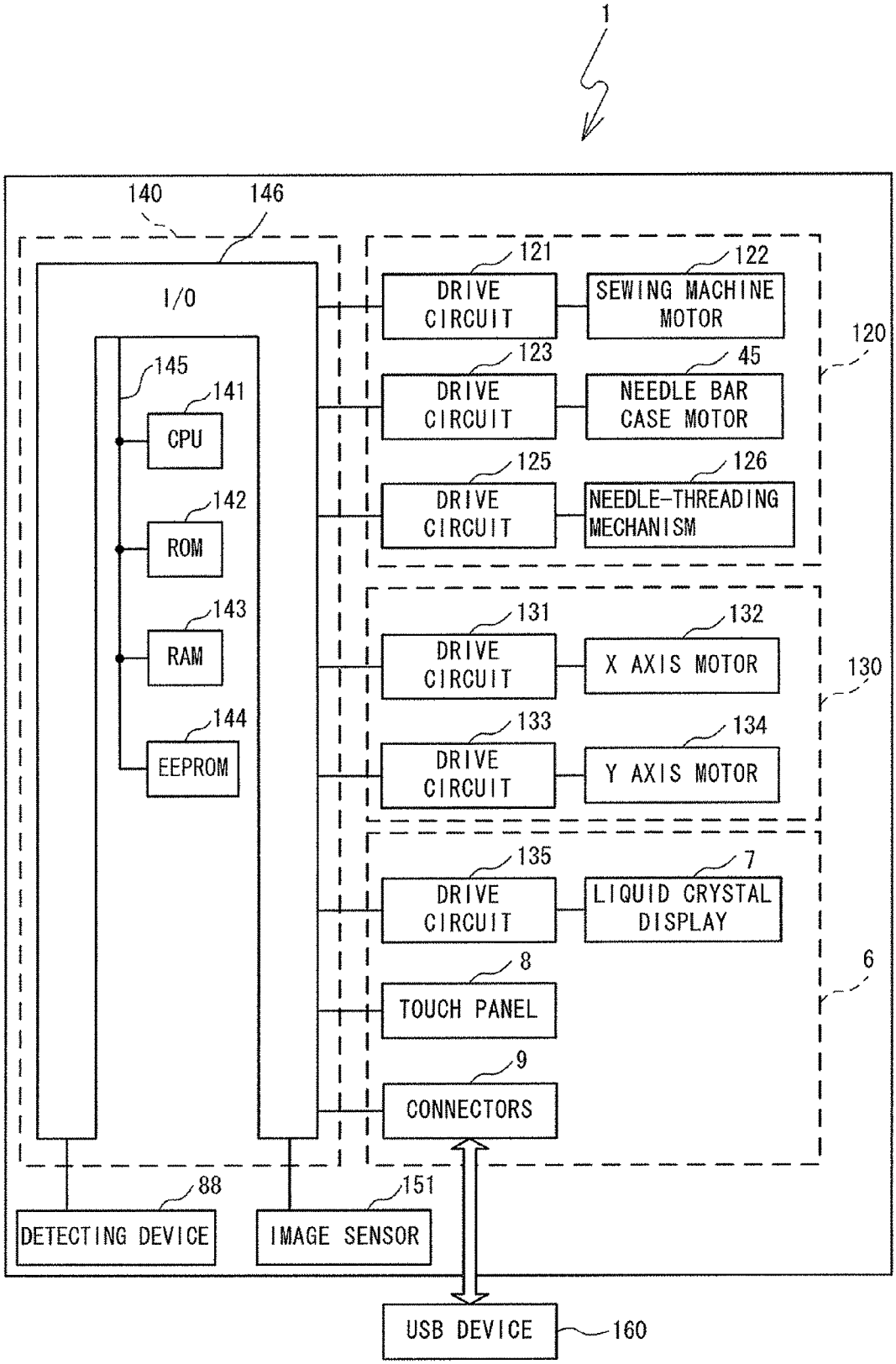
FIG. 5 is a block diagram that shows an electrical configuration of the multi-needle sewing machine 1.

Next, the electrical configuration of the sewing machine 1 will be explained with reference to FIG. 5. As shown in FIG. 5, the sewing machine 1 includes a needle drive portion 120, a sewn object drive portion 130, the operation portion 6, the detecting device 88, the image sensor 151, and the control portion 140. The needle drive portion 120, the sewn object drive portion 130, the operation portion 6, and the control portion 140 will each be described in detail below.

The needle drive portion 120 includes the sewing machine motor 122, a drive circuit 121, the needle bar case motor 45, a drive circuit 123, a needle-threading mechanism 126, and a drive circuit 125. The sewing machine motor 122 moves the needle bars 31 reciprocally up and down. The drive circuit 121 drives the sewing machine motor 122 in accordance with a control signal from the control portion 140. The needle bar case motor 45 moves the needle bar case 21 to the left and to the right in relation to the body 20 of the sewing machine 1. The drive circuit 123 drives the needle bar case motor 45 in accordance with a control signal from the control portion 140. The needle-threading mechanism 126 is not shown in detail in the drawings, but it is provided below the front end of the arm 4 and is a mechanism for threading the upper thread 15 (refer to FIG. 1) through the eye (not shown in the drawings) of the needle 35 attached to the needle bar 31 that is positioned directly above the needle hole 36. The drive circuit 125 drives the needle-threading mechanism 126 in accordance with a control signal from the control portion 140.

The sewn object drive portion 130 includes the X axis motor 132, a drive circuit 131, the Y axis motor 134, and a drive circuit 133. The X axis motor 132 moves the embroidery frame 84 (refer to FIG. 1) to the left and to the right. The drive circuit 131 drives the X axis motor 132 in accordance with a control signal from the control portion 140. The Y axis motor 134 moves the embroidery frame 84 forward and backward. The drive circuit 133 drives the Y axis motor 134 in accordance with a control signal from the control portion 140.

The operation portion 6 includes the touch panel 8, the connectors 9, a drive circuit 135, and the LCD 7. The drive circuit 135 drives the LCD 7 in accordance with a control signal from the control portion 140. The connectors 9 are provided with functions that connect to the USB device 160. The USB device 160 may be a personal computer, a USB flash drive, or another sewing machine 1, for example.

The control portion 140 includes a CPU 141, a ROM 142, a RAM 143, an EEPROM 144, and an input/output interface (I/O) 146, all of which are connected to one another by a bus 145. The needle drive portion 120, the sewn object drive portion 130, the operation portion 6, the image sensor 151, and the detecting device 88 are each connected to the I/O 146. The CPU 141, the ROM 142, the RAM 143, and the EEPROM 144 will be explained in detail below.

The CPU 141 conducts main control over the sewing machine 1 and, in accordance with various types of programs that are stored in a program storage area (not shown in the drawings) in the ROM 142, executes various types of computations and processing that relating to sewing. The programs may also be stored in an external storage device such as a flexible disk or the like.

The ROM 142 is provided with a plurality of storage areas that include the program storage area and a pattern storage area, although these are not shown in the drawings. Various types of programs for operating the sewing machine 1, including a main program, are stored in the program storage area. The main program is a program for executing main processing that will be described later. Embroidery data (pattern data) for sewing embroidery patterns (partial patterns) are stored in the pattern storage area in association with pattern IDs. The pattern IDs are used in processing that specifies an embroidery pattern.

The RAM 143 is a storage element that can be read from and written to as desired, and storage areas that store computation results and the like from computational processing by the CPU 141 are provided in the RAM 143 as necessary. The EEPROM 144 is a nonvolatile storage element that can be read from and written to as desired, and various types of parameters for the sewing machine 1 to execute various types of processing are stored in the EEPROM 144.

Figure 6:
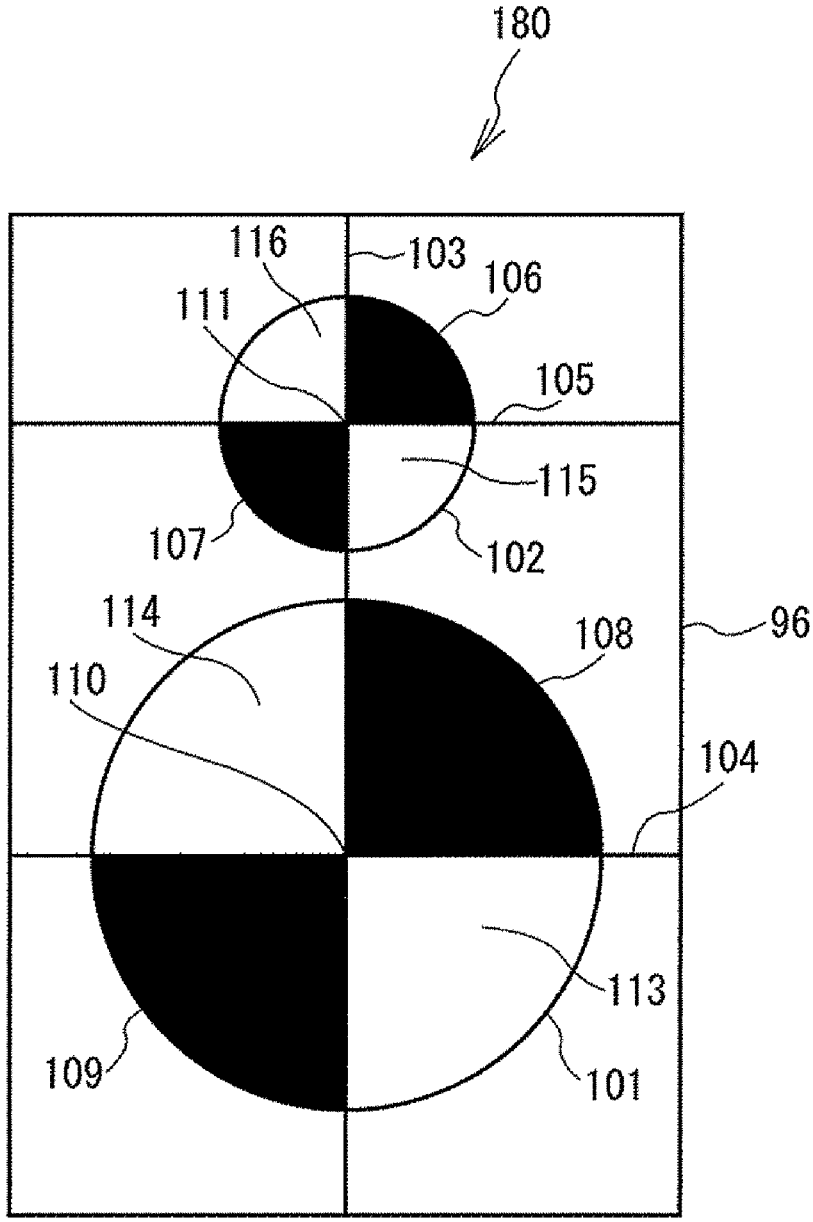
FIG. 6 is an explanatory figure of a marker 180.

Next, a marker 180 will be explained with reference to FIG. 6. The left, right, up, and down directions in FIG. 6 respectively correspond to the left, right, up, and down directions in the marker 180. The marker 180 may be affixed onto the top surface of the work cloth 39 to specify the position on the work cloth 39 on which the embroidery pattern is to be sewn. The marker 180 that is shown in FIG. 6 is a thin, transparent base material sheet 96 that is rectangular in shape and measures three centimeters long by two centimeters wide. A pattern is drawn on one surface of the base material sheet 96. Specifically, a first circle 101 and a second circle 102 are drawn on the base material sheet 96. The second circle 102 is disposed above the first circle 101 and has a smaller diameter than does the first circle 101. Line segments 103 to 105 are also drawn on the base material sheet 96. The line segment 103 is a line segment that extends from the top edge to the bottom edge of the marker 180 and passes through a center 110 of the first circle 101 and a center 111 of the second circle 102. The line segment 104 is a line segment that is orthogonal to the line segment 103 and passes through the center 110 of the first circle 101, extending from the right edge to the left edge of the marker 180. The line segment 105 is a line segment that is orthogonal to the line segment 103 and passes through the center 111 of the second circle 102, extending from the right edge to the left edge of the marker 180.

Of the four areas that are bounded by the perimeter of the first circle 101, the line segment 103 and the line segment 104, an upper right area 108 and a lower left area 109 are filled in with black, and a lower right area 113 and an upper left area 114 are filled in with white. Similarly, of the four areas that are bounded by the second circle 102, the line segment 103 and the line segment 105, an upper right area 106 and a lower left area 107 are filled in with black, and a lower right area 115 and an upper left area 116 are filled in with white. All other parts of the surface on which the pattern of the marker 180 is drawn are transparent. The back surface of the marker 180 (the surface on which the pattern is not drawn) is coated with a transparent adhesive. When the marker 180 is not in use, a release paper (not shown in the drawings) is affixed to the back surface of the marker 180. The user may peel the marker 180 off the release paper and affixes the marker 180 onto the work cloth 39.

Next, the main processing will be explained with reference to FIGS. 7 to 15. In the main processing, processing is performed that, based on an image that has been generated by the image sensor 151, specifies the position of the marker 180 that has been positioned within a specific range. The specific range is the range on the sewing object to be captured the image by the image sensor 151. In the present embodiment, the specific range is one of the sewing area 86 within the embroidery frame 84 and a range that is designated by the user. As a specific example, consider a case in which the marker 180 is positioned within a range 190 as shown in FIG. 4. In a case where a main processing start command has been input by a panel operation, the main processing is performed by the CPU 141 in accordance with a program that is stored in the ROM 142 in FIG. 5. In the explanation that follows, the left-right direction in FIG. 4 is called the width direction. The up-down direction in FIG. 4 is called the height direction.

Figure 7:
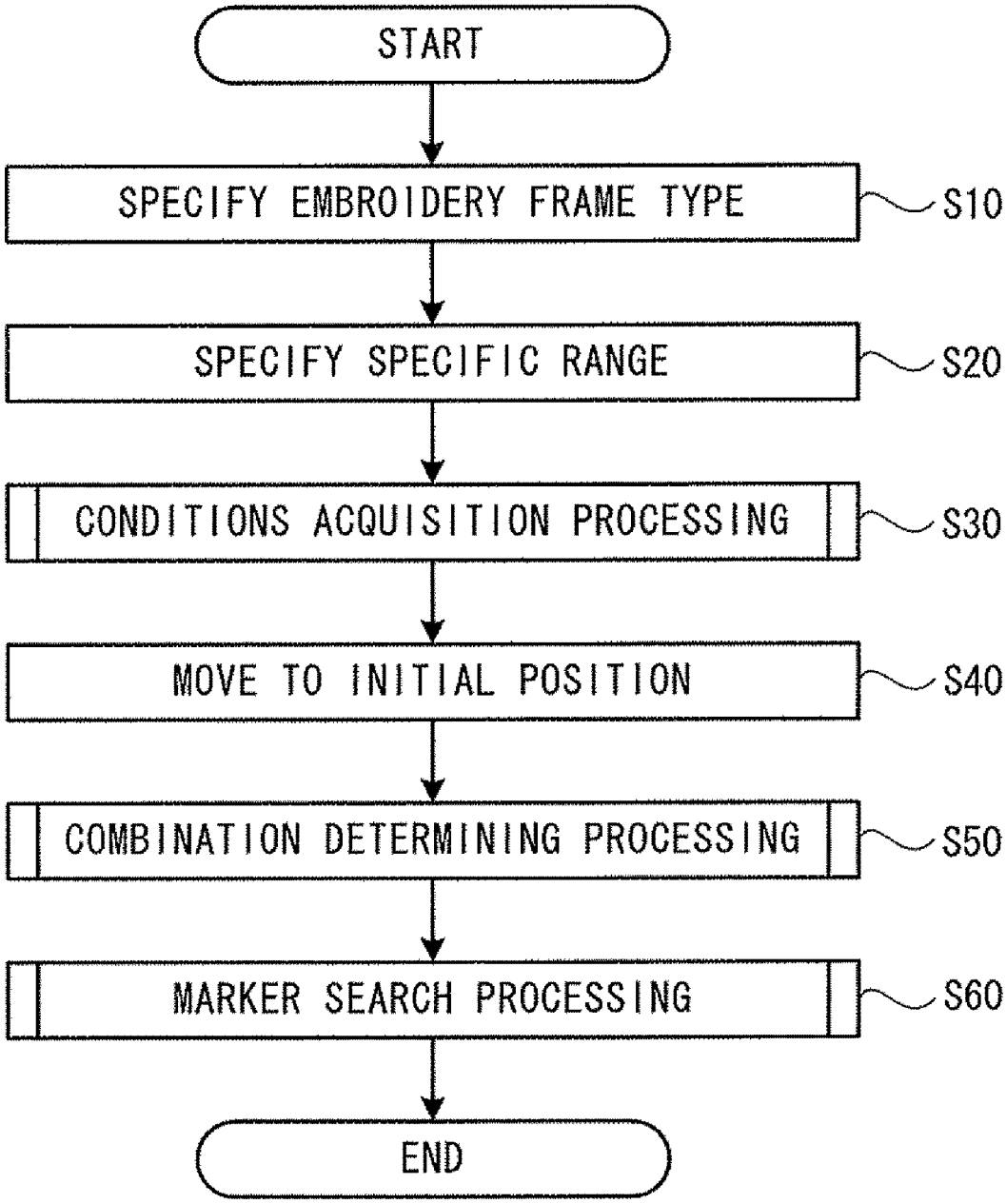
FIG. 7 is a flowchart of main processing.
Figure 15:
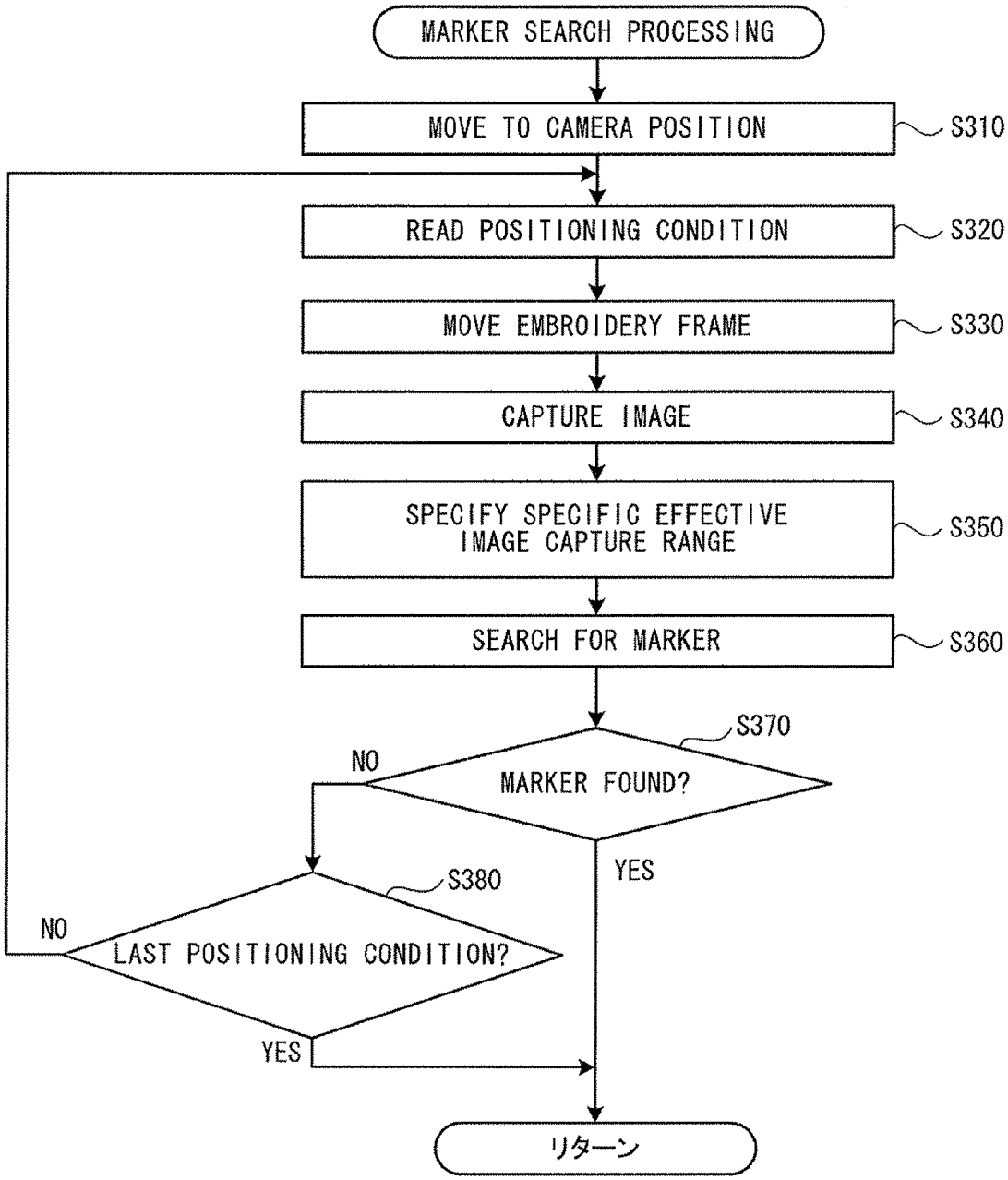
FIG. 15 is a flowchart of marker search processing that is performed in the main processing in FIG. 7.

As shown in FIG. 7, in the main processing, first, the type of the embroidery frame 84 is specified based on the output signal from the detecting device 88, and the specified type of the embroidery frame 84 is stored in the RAM 143 (Step S 10). In a case where the specific range is not specified based on the type of the embroidery frame 84, Step S10 may be omitted. Next, a range on the work cloth 39 where marker search processing will be performed is specified as the specific range, and the specific range is stored in the RAM 143 (Step S20). The marker search processing, as described later with reference to FIG. 15, is processing that specifies the position of the marker 180 on the work cloth 39 based on a captured image of the work cloth 39. In a case where the user has designated a range, the range that the user has designated is specified as the specific range. In a case where the user has not designated a range, the sewing area that corresponds to the type of the embroidery frame 84 is specified as the specific range. The correspondence relationship between the type of the embroidery frame 84 and the sewing area is stored in advance in one of the ROM 142 and the EEPROM 144. As the specific example, consider a case in which, at Step S20, the range 190 in FIG. 4 has been designated by the user. The range 190 is a rectangular range that is 100 millimeters long in the width direction and 130 millimeters long in the height direction, with its upper left corner at the origin point of the embroidery coordinate system.

Next, conditions acquisition processing is performed (Step S30). In the conditions acquisition processing, an effective image capture range for each of the camera positions and a unit processing time are computed. The camera position represents an image capture condition of the image sensor 151. Specifically, the camera position represents the relative position of the image sensor 151 in relation to the body 20 when the image sensor 151 captures an image of the work cloth 39. In the present embodiment, the previously described first camera position and second camera position have been set as the camera positions. The effective image capture range is a range that has been set as an effective range within the range in which an image of the sewing object is captured. In the present embodiment, the effective image capture range is a rectangular range that is within the image of the work cloth 39 that has been captured and generated by the image sensor 151 and that excludes a range in which an image is captured of a member with which the sewing machine 1 is provided. Therefore, only the image of the work cloth 39 is included in the image within the effective image capture range. The effective image capture range is expressed in terms of the coordinates of the world coordinate system. The unit processing time is the processing time for a single image that is necessary for searching for the marker 180.

Figure 8:
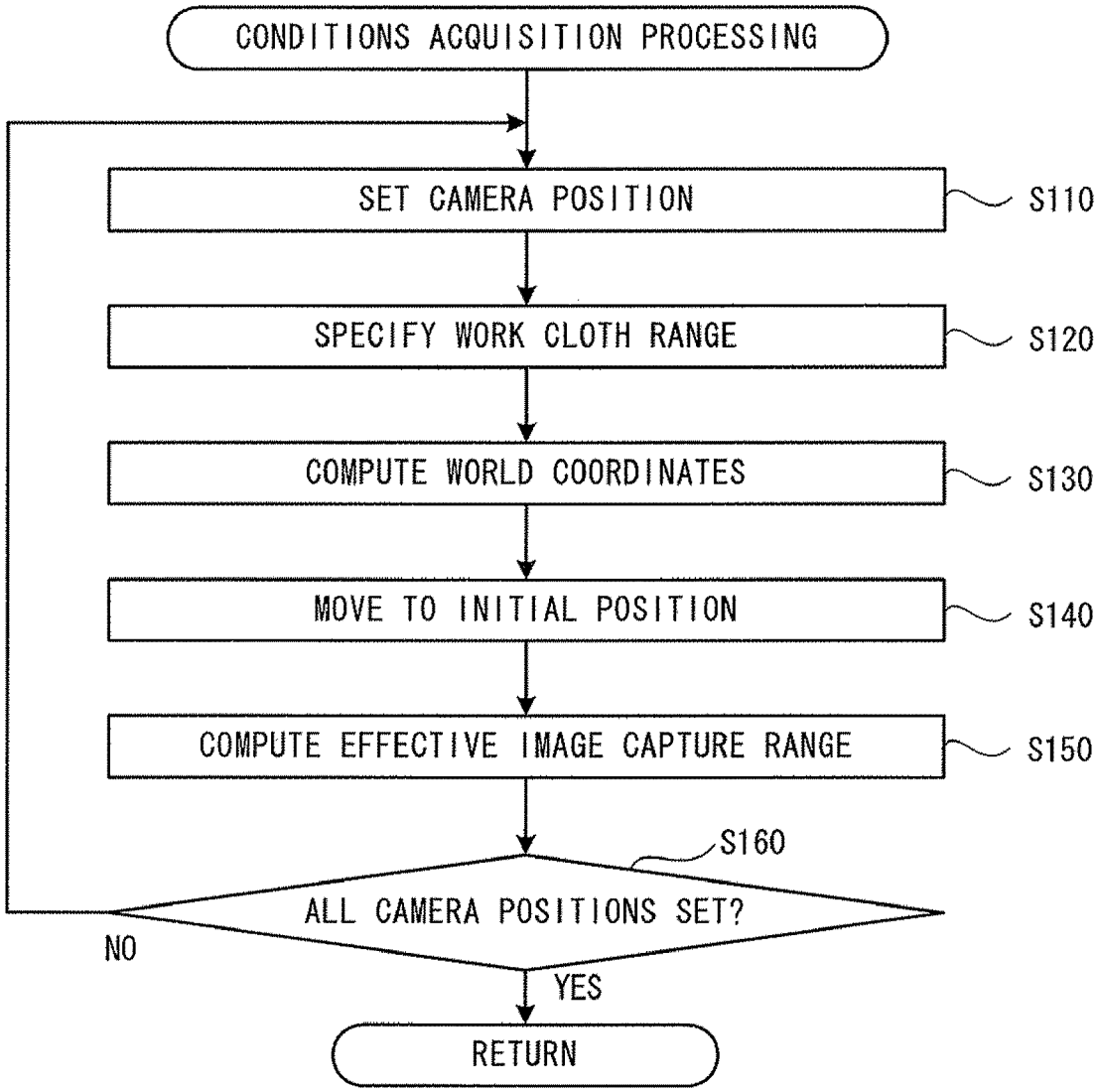
FIG. 8 is a flowchart of conditions acquisition processing that is performed in the main processing in FIG. 7.

The details of the conditions acquisition processing will be explained with reference to FIGS. 8 to 11. As shown in FIG. 8, in the conditions acquisition processing, first, the J-th camera position is set (Step S110). The number J is a positive integer. The initial value of J is 1. The first time that Step S110 is performed, the first camera position is read and is set as the camera position. The second time that Step S110 is performed, the second camera position is read and is set as the camera position.

Figure 9:
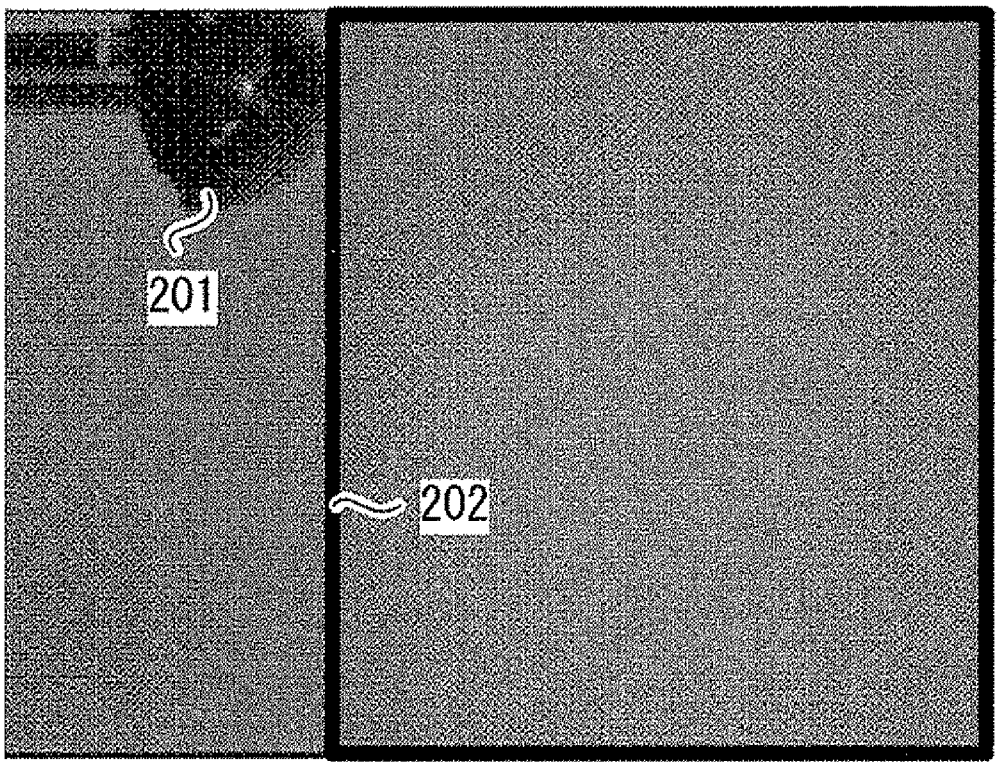
FIG. 9 is an image that is acquired in a case where an image of a work cloth is captured at a first camera position.
Figure 10:
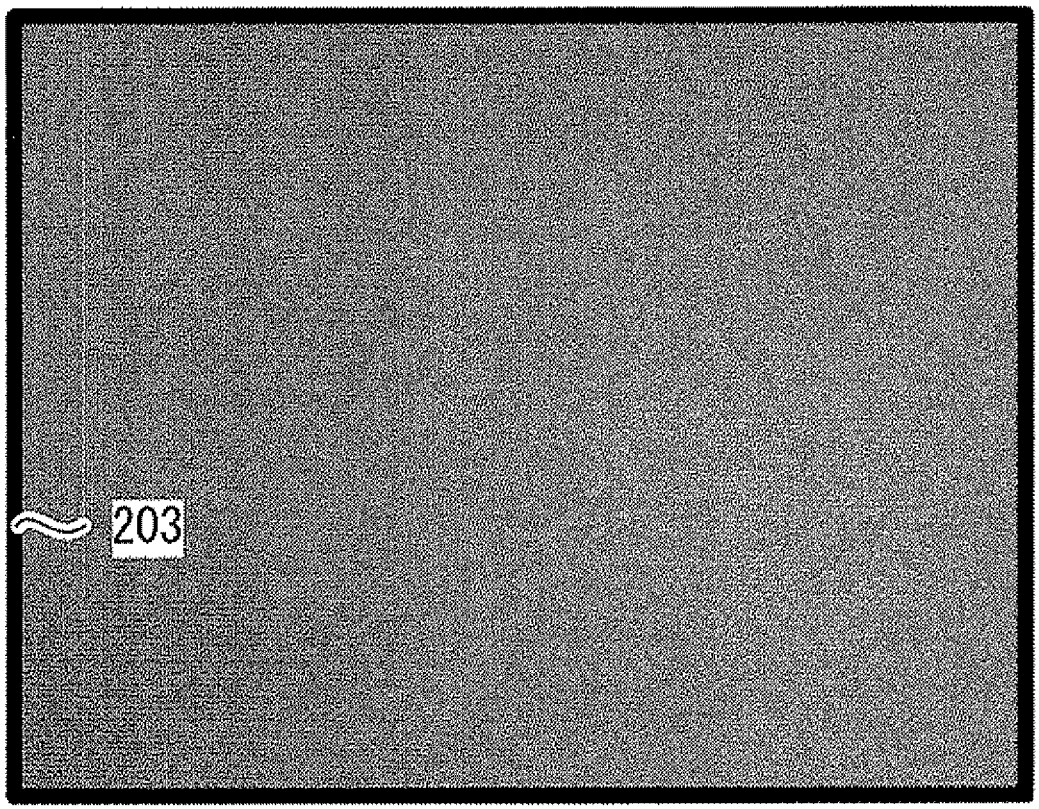
FIG. 10 is an image that is acquired in a case where an image of the work cloth is captured at a second camera position.
Figure 12:
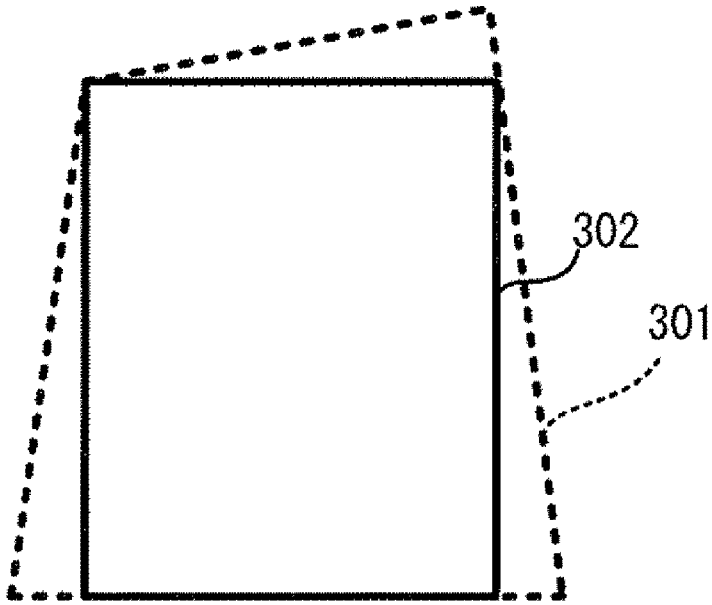
FIG. 12 is an explanatory figure of processing that, based on a work cloth range 301 that is expressed in terms of the world coordinates, sets an effective image capture range 302 that is expressed in terms of the world coordinates.

Next, a work cloth range is specified, and the specified work cloth range is stored in the RAM 143 (Step S120). The work cloth range is the largest rectangular range, expressed in terms of an image coordinate system, for the portion of the image that has been captured at the camera position that was set at Step S110, and the portion of the image includes only the work cloth. The work cloth range may be computed by calculating the position of the work cloth 39 and the positions of the members with which the body 20 is provided. In a case where the image sensor 151 is positioned at the first camera position, an image like the example that is shown in FIG. 9 is generated by the image sensor 151. In FIG. 9, a portion 201 of the needle-threading mechanism 126 (refer to FIG. 5) has been captured in the image. Therefore, a line that describes a rectangle 202 and the area within the rectangle 202 is specified as the work cloth range. In a case where the image sensor 151 is positioned at the second camera position, an image like the example that is shown in FIG. 10 is generated by the image sensor 151. In FIG. 10, only the work cloth is captured within the image. Therefore, a line that describes a rectangle 203 and the area within the rectangle 203 is specified as the work cloth range. In each of FIG. 9 and FIG. 10, the upper left corner of the rectangle is defined as a first point, the upper right corner is defined as a second point, the lower left corner is defined as a third point, and the lower right corner is defined as a fourth point. In these cases, the image coordinate system coordinates for the first point to the fourth point in each of FIG. 9 and FIG. 10 are derived as shown in FIG. 11, for example.

Next, three-dimensional coordinates in the world coordinate system are computed for the work cloth range that was specified at Step S120, and the computed coordinates are stored in the RAM 143 (Step S130). A known method may be used as the method for converting the coordinates of the image coordinate system for the work cloth range to the three-dimensional coordinates of the world coordinate system. For example, Japanese Laid-Open Patent Publication No. 2009-172123 discloses the three-dimensional coordinate conversion processing, the relevant portions of which are herein incorporated by reference. At Step S130, the image coordinate system coordinates for the first point to the fourth point are converted to the three-dimensional coordinates of the world coordinate system (hereinafter called the world coordinates), as in FIG. 11, for example. Next, the effective image capture range is set based on the world coordinates for the work cloth range that were computed at Step S130, and the effective image capture range that is set is stored in the RAM 143 (Step S140). Consider, for example, a case like that in FIG. 12, in which a work cloth range 301 is expressed in terms of the world coordinates that were computed at Step S130. In this case, an effective image capture range 302 is specified as the largest rectangle that fits within the work cloth range 301. In a case where the first point to the fourth point in the effective image capture range 302 are set in the same manner as in the work cloth range 301, the world coordinates for the first point to the fourth point in the effective image capture range 302, as in FIG. 11, are derived at Step S140. In FIG. 11, the world coordinates are expressed in millimeters.

Next, a unit processing time iT is computed, and the computed unit processing time iT is stored in the RAM 143 (Step S150). The unit processing time iT is computed by multiplying the surface area of the effective image capture range that was set at Step S140 times a processing time per unit surface area. The surface area of the effective image capture range at the first camera position is 3096.84 square millimeters, and the surface area of the effective image capture range at the second camera position is 4619.69 square millimeters. In a case where the processing time per unit surface area is 0.005 milliseconds per dot, the unit processing time iT at the first camera position is 1.032 seconds, and the unit processing time iT at the second camera position is 1.540 seconds. In the present embodiment one dot has a surface area of 0.015 square millimeters. Next, in a case where a camera position exists that has not been read at Step S110 (NO at Step S160), the number J is incremented, and the processing returns to Step S110. In a case where all of the camera positions have been read at Step S110 (YES at Step S160), the conditions acquisition processing is terminated, and the processing returns to the main processing in FIG. 7.

In the main processing in FIG. 7, following Step S30, commands are output to the drive circuit 131 and the drive circuit 133, and the embroidery frame 84 is moved to an initial position (Step S40). The initial position may be, for example, a position where the upper left corner of the sewing area 86 (the origin point of the embroidery coordinate system), which corresponds to the embroidery frame 84, is at the needle drop point. Next, combination determining processing is performed (Step S50). In the combination determining processing, a combination of the camera position as a specific image capture condition and a positioning condition for the embroidery frame 84 is determined. The specific image capture condition is at least one image capture condition, among a plurality of image capture conditions, for capturing at least one image that covers the entirety of the specific range. The positioning condition is a condition that includes at least one position to which the embroidery frame 84 is moved. In the present embodiment, the image that shows the specific range is used in the processing that identifies the position of the marker 180. therefore, in the present embodiment, a plurality of candidates are derived for the combination of the camera position of the image sensor 151 and the positioning condition for the embroidery frame 84, and from among the plurality of the candidates, the combination that is determined by taking into consideration the time that is required in order to capture the at least one image that covers the entirety of the specific range and the maximum time that is required in order to identify the position of the marker 180. Considering that the image of the effective image capture range is used in searching for the marker 180, it is preferable for the positioning condition to be determined such that the effective image capture ranges (preferably, the longitudinal length ranges of the marker 180) in a plurality of images for which the positioning conditions differ will overlap at least partially (preferably, within a range of the longitudinal length of the marker 180). In the present embodiment, in order to make the explanation simpler, a case will be explained in which the combination is determined without taking the overlapping of the effective image capture ranges into consideration.

Figure 13:
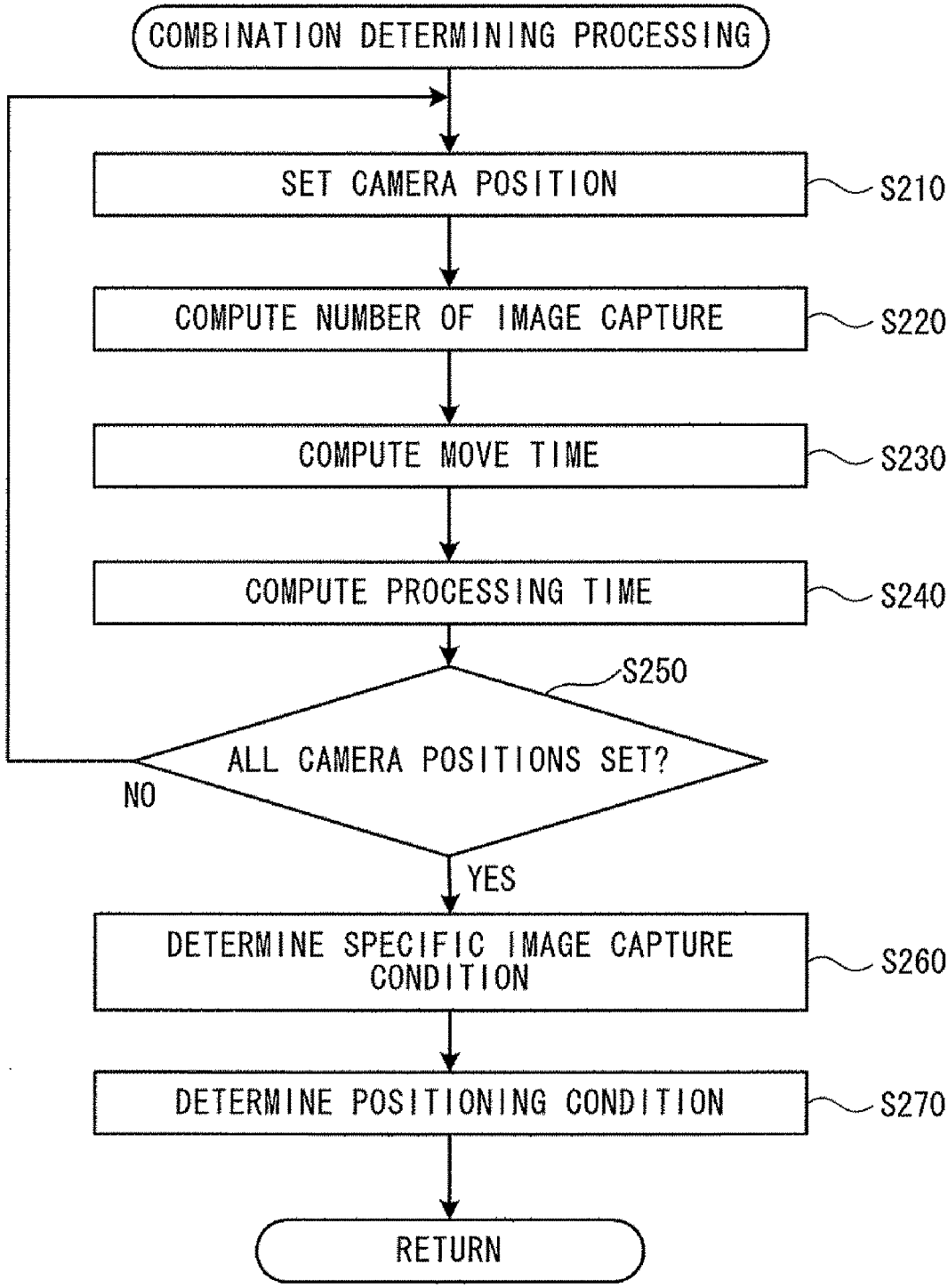
FIG. 13 is a flowchart of combination determining processing that is performed in the main processing in FIG. 7.

The details of the combination determining processing will be explained with reference to FIG. 13. As shown in FIG. 13, first, the camera position is set in the same manner as at Step S110 in FIG. 8 (Step S210). Next, the processing computes a number of image captures cN at the camera position that was set at Step S210, the image captures being required in order to capture at least one image that covers the entirety of the specific range that was set at Step S20 in FIG. 7, and the computed number of image captures cN is stored in the RAM 143 (Step S220). The number of image captures cN is computed by multiplying a number of searches wN in the width direction times a number of searches hN in the height direction. The number of searches wN in the width direction is a value that is computed by taking a length AW of the width direction of the specific range that was specified at Step S20 in FIG. 7, dividing AW by a length rW of the width direction of the effective image capture range that was set at Step S140 in FIG. 8, and rounding the result up to the next integer. AW is 100 millimeters, rW for the first camera position is 59.1 millimeters, and rW for the second camera position is 58.7 millimeters. The number of searches hN in the height direction is a value that is computed by taking a length AH of the height direction of the specific range that was specified at Step S20, dividing AH by a length rH of the height direction of the effective image capture range that was set at Step S140, and rounding the result up to the next integer. AH is 130 millimeters, rH for the first camera position is 52.4 millimeters, and rH for the second camera position is 78.7 millimeters. Therefore, at the first camera position, wN is 2, hN is 3, and cN is 6. At the second camera position, wN is 2, hN is 2, and cN is 4.

Next, a move time mT for the embroidery frame 84 is computed, and the computed move time mT is stored in the RAM 143 (Step S230). The move time mT for the embroidery frame 84 is computed by multiplying the move distance of the embroidery frame 84 times the move time per unit distance. The move distance of the embroidery frame 84 is the distance in a case where the embroidery frame 84 is moved to each of the positions that correspond to the number of image captures cN that was computed at Step S220. The two-dimensional coordinates for each of the positions in the world coordinate system are expressed by the equation (x, y)=(rW/2+rW×(n−1)+(x coordinate of camera position), rH/2+rH×(m−1)+(y coordinate of camera position)). Here, the number n is an integer in the range from 1 to the number of searches wN in the width direction, and the number m is an integer in the range from 1 to the number of searches hN in the height direction. The coordinates (x, y) of the camera position are coordinates in the embroidery coordinate system that express the position of the lens of the image sensor 151. The coordinates (x, y) of the first camera position are (0, 0), and the coordinates (x, y) of the second camera position are (48, 0). In a case where the camera positions are the first camera position and the second camera position, the position to which the embroidery frame 84 is moved and the move distance are computed as shown in FIG. 14. In a case where the move time per unit distance for the embroidery frame 84 is 0.1 seconds per millimeter, the value of mT that corresponds to the first camera position is 32.16 seconds, and the value of mT that corresponds to the second camera position is 28.29 seconds.

Next, a processing time pT that corresponds to the camera position that was set at Step S210 is computed, and the computed processing time pT is stored in the RAM 143 (Step S240). The processing time pT is a time that takes into consideration the time that is required for image processing and the time that is required for moving the embroidery frame 84. In the marker search processing in the present embodiment, as will be described later with reference to FIG. 15, the image processing is performed every time a captured image of the work cloth 39 is acquired, and the image processing is terminated at the point when the (world coordinates) position of the marker 180 has been identified. Therefore, in some cases, the position of the marker 180 is identified before the images are acquired for all of the positioning conditions. In contrast, the time that is required for the image processing is set on the assumption that the marker search processing is performed for all of the images that correspond to each of the positioning conditions. Specifically, the processing time pT is computed by multiplying the unit processing time iT that was computed at Step S150 in FIG. 8 times the number of image captures cN that was computed at Step S220, then adding the move time mT that was computed at Step S230. The value of pT for the first camera position is 38.35 seconds, and the value of pT for the second camera position is 34.45 seconds. Next, in a case where a camera position exists that has not been read at Step S210 (NO at Step S250), the processing returns to Step S210.

In a case where all of the camera positions have been read at Step S210 (YES at Step S250), the specific image capture condition is determined, and the determined specific image capture condition is stored in the RAM 143 (Step S260). In the present embodiment, the specific image capture condition is the one camera position where the processing time pT is the shortest. To take the specific example, based on the processing time pT, the second camera position is determined as the specific image capture condition (Step S260). Next, the positioning condition is determined, and the determined positioning condition is stored in the RAM 143 (Step S270). The positioning condition that is determined at Step S270 is the positioning of the embroidery frame 84 that corresponds to the camera position where the processing time pT is the shortest. To take the specific example, in FIG. 14, a first frame position to a fourth frame position that correspond to the second camera position are determined as the positioning conditions. Next, the combination determining processing is terminated, and the processing returns to the main processing in FIG. 7.

In the main processing in FIG. 7, following Step S50, the marker search processing is performed (Step S60). In the marker search processing, the position of the marker 180 that is disposed on the surface of the work cloth 39 is identified based on the specific image capture condition and the positioning condition that were determined at Step S50. The details of the marker search processing will be explained with reference to FIG. 15. As shown in FIG. 15, in the marker search processing, first, a command is output to the drive circuit 123, and the image sensor 151 is moved by the needle bar case moving mechanism 40 to the position of the specific image capture condition that was determined at Step S260 in FIG. 13 (Step S310). By the processing at Step S310, the specific image capture condition is set as an actual image capture condition. Next, a K-th frame position is read from among the positioning conditions that were determined at Step S270 in FIG. 13, and the K-th frame position among the positioning conditions is stored in the RAM 143 (Step S320). The number K is an integer that is at least 1. The initial value of the number K is 1. At Step S320, to take the specific example, the first frame position to the fourth frame position in FIG. 14 that correspond to the second camera position are read in order. Next, commands are output to the drive circuit 131 and the drive circuit 133, and the embroidery frame 84 is moved to the position that was read at Step S320 (Step S330).

Next, in a state in which the actual image capture condition has been set and the embroidery frame has been positioned, an image of the work cloth 39 is captured by the image sensor 151, and the image that is generated by the image capture is stored in the RAM 143 (Step S340). Next, a specific effective image capture range of the image that was generated at Step S340 is specified, based on the world coordinates of the specific effective image capture range that was set at Step S140 in FIG. 8, and the image within the specified specific effective image capture range is stored in the RAM 143 (Step S350). The specific effective image capture range is one of the effective image capture ranges, and corresponds to the actual image capture condition. Next, a determination is made as to whether an image of the marker 180 is contained within the image within the specific effective image capture range that was specified at Step S350 (Step S360). Step S360 is performed using a known method. For example, Japanese Laid-Open Patent Publication No. 2009-172123 discloses the marker search method, the relevant portions of which are herein incorporated by reference. In a case where an image of the marker 180 is not contained within the image within the specific effective image capture range that was specified at Step S350 (NO at Step S370), a determination is made as to whether all of the positioning conditions have been read at Step S320 (Step S380). In a case where a positioning condition exists that has not been read (NO at Step S380), the number K is incremented, and the processing returns to Step S320. In a case where all of the positioning conditions have been read (YES at Step S380), as well as in a case where an image of the marker 180 has been detected at Step S360 (YES at Step S370), the marker search processing is terminated, and the processing returns to the main processing in FIG. 7. In the main processing in FIG. 7, following Step S60, the main processing is terminated. The position of the marker 180 that is specified by the main processing is used for processing that specifies a sewing position in the embroidery pattern, for example.

The sewing machine 1 in the present embodiment is able to acquire an image that shows only the work cloth 39 (refer to FIG. 4), even in a case where a member of the body 20, such as the needle 35, the presser foot 71 (refer to FIG. 2), the needle-threading mechanism 126, or the like, is positioned within the image capture range of the image sensor 151. The sewing machine 1 also sets the specific image capture condition from among the first camera position and the second camera position, which are a plurality of image capture conditions for which the effective image capture ranges are different. This makes it possible for the actual image capture condition to be switched automatically in accordance with the specific range that is specified at Step S20 in FIG. 7. The sewing machine 1 automatically sets the specific image capture condition such that the processing time pT will be the shortest possible, taking into consideration the image processing time and the move time for the embroidery frame 84. The sewing machine 1 is therefore able to reduce the effort that is required of the user, compared to a case in which the user selects, from among a plurality of image capture conditions, an image capture condition that is suitable for the specific range.

Furthermore, because the specific image capture condition is set based on the condition that the processing time pT will be the shortest possible, the sewing machine 1 is able to acquire the image data that corresponds to the specific range efficiently and in a short time. Because the sewing machine 1 is provided with the detecting device 88, the sewing machine 1 is able to specify the type of the embroidery frame 84 based on the detection object portion 87 of the embroidery frame 84. Therefore, by the simple operation of mounting the embroidery frame 84 in the embroidery frame moving mechanism 11, the user is able to set the specific range automatically. This makes it possible for the sewing machine 1 to eliminate the effort that is required if the user sets the specific range separately from the operation of mounting the embroidery frame 84 in the embroidery frame moving mechanism 11.

The sewing machine of the present disclosure is not limited to the embodiment that is described above, and various types of modifications may be made within the scope of the present disclosure. For example, the modifications that are described below from (A) to (C) may be made as desired.

(A) The configuration of the sewing machine 1 can be modified as desired. The sewing machine 1 may also be a domestic sewing machine. For example, the type and the positioning of the image sensor 151 may be modified as desired. The image sensor 151 may also be an image capture element other than a CMOS image sensor, such as a CCD camera or the like, for example. The direction in which the embroidery frame moving mechanism 11 moves the X carriage 22, for example, can also be modified as desired.

(B) A plurality of the image capture conditions, each with a different effective image capture range, may be set. For example, the plurality of image capture conditions may each include at least one of an image capture direction of the image capture device, an enlargement/reduction ratio, and the camera position. The sewing machine may be provided with a mechanism that changes the actual image capture conditions in accordance with the selected image capture conditions. For example, in a case where the camera position is set as the image capture condition, a mechanism may also be used as the image capture device moving mechanism that changes the camera position that, using an actuator as a drive source, drives the image sensor 151 in at least one of a horizontal direction and a vertical direction.

(C) The main processing may also be modified as necessary. For example, the modifications hereinafter described may be made to the main processing.

(C-1) The specific range that is set at Step S20 may be one of a range that is set in accordance with the type of the embroidery frame and a range that is designated by the user. The range that is set in accordance with the type of the embroidery frame may be a pre-set range such as the sewing area or the like. The type of the embroidery frame may also be designated by a user designation.

(C-2) The combination determining processing in FIG. 13 can also be modified as desired. For example, a plurality of image capture conditions may be included in a single combination. To take another example, the combination of the specific image capture condition and the positioning condition may be set based on a combination condition that satisfies at least one condition that is selected from among conditions that include the number of image captures, the embroidery frame move time, the time required in order to change the actual image capture condition, and the image processing time.

(C-2-1) In a case where a combination requiring the least number of image captures is used as the combination condition, a combination that uses the least number of image captures may be set at Steps S260 and S270, based on the number of image captures that was computed at Step S220 in FIG. 13. In that case, Step S150 in FIG. 8, as well as Steps S230 and S240, may be omitted. This makes it possible for the sewing machine to efficiently acquire the image data that corresponds to the specific range.

(C-2-2) In a case where a combination condition requiring the shortest time to capture at least one image that covers the entirety of the specific range is used as the combination condition, the processing time pT may be computed at Step S240 in FIG. 13 based on the move time for the embroidery frame 84 that was computed at Step S230 and on the time that is required in order to change the actual image capture condition. In the case of the embodiment that is described above, the time that is required in order to change the actual image capture condition is the time that is required in order to move the image sensor 151, that is, the time that is required in order to move the needle bar case 21. Specifically, in the sewing machine 1 in the embodiment that is described above, the time that is required in order to change the actual image capture condition may be computed based on the time (0.5 seconds, for example) that is required in order to move the needle bar case 21 one of toward the right and toward the left along the X axis. In this case, Step S150 in FIG. 8 may be omitted. This makes it possible for the sewing machine to efficiently acquire the image data that corresponds to the specific range in a short time.

(C-2-3) In a case where a combination requiring the shortest image processing time that is required in order to search the marker 180 is used as the combination condition, the processing time pT may be computed at Step S240 according to multiplying the unit processing time iT that was computed at Step S150 in FIG. 8 times the number of image captures cN that was computed at Step S220. In that case, the processing at Step S230 may be omitted. This makes it possible for the sewing machine to efficiently perform the marker search processing for the specific range in a short time. The object of the marker search processing is the image within the specific effective image capture range, but where necessary, a portion of the specific effective image capture range may be made the object of the image processing such as the marker search processing.

(C-3) The marker search processing is performed at Step S60 of the main processing, but the present disclosure is not limited to this arrangement. For example, the image data that is acquired at Step S340 may be used in processing that generates a combined image that combines a plurality of images. The configuration of the marker for which the marker search processing searches may also be modified. For example, a pattern, a color, a shape, and a material may be incorporated into the configuration of the marker.

(C-4) The combination that is set in the combination determining processing in FIG. 13 may also be stored in a nonvolatile storage device such as an EEPROM or the like. In a case where it is acceptable for the image capture condition and the positioning condition to be the same as in the preceding combination, the processing time for the main processing can be shortened by reading the combination that is stored in the storage device. In the same manner, the effective image capture range for each of the camera positions that are acquired in the conditions acquisition processing and the unit processing time may also be stored in a nonvolatile storage device such as an EEPROM or the like. In a case where the computation results are the same as the preceding computation results, the processing time for the main processing can be shortened by reading the combination conditions that are stored in the storage device.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a body;

an embroidery frame moving mechanism that is adapted to removably hold and move an embroidery frame in relation to the body, the embroidery frame holding a sewing object;

an image capture device that is provided with a function to capture a plurality of images of the sewing object under a plurality of image capture conditions, respectively, the plurality of the image capture conditions corresponding to different effective image capture ranges, each of the effective image capture ranges being set as an effective range within a range in which the image of the sewing object is captured;

a specifying device that specifies, as a specific range, a range on the sewing object to be captured by the image capture device;

a determining device that, based on the specific range specified by the specifying device, determines a combination of a specific image capture condition and a positioning condition, the specific image capture condition being a condition for capturing at least one image that covers an entirety of the specific range and including at least one of the plurality of the image capture conditions, the positioning condition being a condition including at least one position to which the embroidery frame can be moved;

a setting device that sets the specific image capture condition that has been determined by the determining device as an actual image capture condition for the image capture device;

a positioning device that, by controlling the embroidery frame moving mechanism, positions the embroidery frame in accordance with the positioning condition that has been determined by the determining device; and an acquiring device that, in a state in which the actual image capture condition has been set by the setting device and the embroidery frame has been positioned by the positioning device, causes the image capture device to capture an image of the sewing object and acquires image data that corresponds to a specific effective image capture range, the specific effective image capture range being one of the effective image capture ranges and corresponding to the actual image capture condition.

2. The sewing machine according to claim 1, further comprising:

an image capture device moving mechanism that moves the image capture device, wherein the determining device determines, as the specific image capture condition, a relative position of the image capture device in relation to the body, and the setting device, by controlling the image capture device moving mechanism, positions the image capture device in a position that corresponds to the specific image capture condition.

3. The sewing machine according to claim 1, wherein the determining device derives a plurality of candidate combinations of the specific image capture condition and the positioning condition and selects, from among the plurality of candidate combinations, a combination requiring a smallest number of image captures that are required in order to capture the at least one image that covers the entirety of the specific range.

4. The sewing machine according to claim 1, wherein the determining device derives a plurality of candidate combinations of the specific image capture condition and the positioning condition and selects, from among the plurality of candidate combinations, a combination requiring a shortest time that is required in order to capture the at least one image that covers the entirety of the specific range.

5. The sewing machine according to claim 1, further comprising:

a marker detecting device that detects a marker that is disposed on the sewing object, based on the image data that has been acquired by the acquiring device and that correspond to the effective image capture range, wherein the determining device derives the plurality of candidate combinations of the specific image capture condition and the positioning condition and selects, from among the plurality of candidate combinations, a combination of which possible maximum time is a shortest, the possible maximum time being a time that can be spent at most in order for the marker detecting device to perform image processing for an entirety of the specific effective image capture range represented by the image data.

6. The sewing machine according to claim 1, further comprising:

a type detecting device that detects a type of the embroidery frame that is mounted in the embroidery frame moving mechanism, wherein the specifying device specifies, as the specific range, a range that is associated with the type of the embroidery frame that has been detected by the type detecting device.

7. A non-transitory computer-readable medium storing a control program executable on a sewing machine, the program comprising instructions that cause a controller of the sewing machine to perform the steps of:

specifying, as a specific range, a range on the sewing object to be captured by a image capture device, the image capture device being provided with a function to capture a plurality of images of the sewing object that is held by an embroidery frame under a plurality of image capture conditions, respectively, the plurality of the image capture conditions corresponding to different effective image capture ranges, each of the effective image capture ranges being set as an effective range within a range in which the image of the sewing object is captured;

determining, based on the specific range, a combination of a specific image capture condition and a positioning condition, the specific image capture condition being a condition for capturing at least one image that covers an entirety of the specific range and including at least one of the plurality of the image capture conditions, the positioning condition being a condition including at least one position to which the embroidery frame can be moved;

setting the specific image capture condition as an actual image capture condition for the image capture device;

positioning the embroidery frame in accordance with the positioning condition, by controlling an embroidery frame moving mechanism that is adapted to removably hold and move the embroidery frame in relation to a body; and causing the image capture device to capture an image of the sewing object and acquiring, in a state in which the actual image capture condition for the image capture device has been set and the embroidery frame has been positioned in accordance with the positioning condition, image data that corresponds to a specific effective image capture range, the specific effective image capture range being one of the effective image capture ranges and corresponding to the actual image capture condition.

8. The non-transitory computer-readable medium according to claim 7, wherein a relative position of the image capture device in relation to the body is determined as the specific image capture condition; and an image capture device moving mechanism that moves the image capture device is controlled such that the image capture device is positioned in a position that corresponds to the specific image capture condition.

9. The non-transitory computer-readable medium according to claim 7, wherein a plurality of candidate combinations of the specific image capture condition and the positioning condition are derived, and a combination requiring a smallest number of image captures that are required in order to capture the at least one image that covers the entirety of the specific range is selected from among the plurality of candidate combinations.

10. The non-transitory computer-readable medium according to claim 7, wherein the plurality of candidate combinations of the specific image capture condition and the positioning condition are derived, and a combination requiring a the shortest time that is required in order to capture the at least one image that covers the entirety of the specific range is selected from among the plurality of candidate combinations.

11. The computer-readable medium according to claim 7, wherein:

the program further includes an instruction that causes the controller of the sewing machine to perform the step of detecting a marker that is disposed on the sewing object based on the image data that corresponds to the effective image capture range; and a plurality of candidate combinations of the specific image capture condition and the positioning condition are derived, and a combination of which possible maximum time is shortest is selected from among the plurality of candidate combinations, the possible maximum time being in order to perform image processing for an entirety of the specific effective image capture range represented by the image data.

12. The non-transitory computer-readable medium according to claim 7, wherein a type of the embroidery frame that is mounted on the embroidery frame moving mechanism is detected by a type detecting device; and a range that is associated with the type of the embroidery frame that has been detected by the type detecting device is specified as the specific range.

* * * * *